US011850873B2

(12) United States Patent
Kosuge

(10) Patent No.: US 11,850,873 B2
(45) Date of Patent: Dec. 26, 2023

(54) RIBBON TRANSPORT MECHANISM AND TAPE PRINTING APPARATUS

(71) Applicant: SEIKO EPSON CORPORATION, Tokyo (JP)

(72) Inventor: Shinsaku Kosuge, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 665 days.

(21) Appl. No.: 16/823,102

(22) Filed: Mar. 18, 2020

(65) Prior Publication Data

US 2020/0298604 A1 Sep. 24, 2020

(30) Foreign Application Priority Data

Mar. 19, 2019 (JP) ..... 2019-051758

(51) Int. Cl.

| | |
|---|---|
| ***B41J 33/22*** | (2006.01) |
| ***B41J 32/00*** | (2006.01) |
| ***B41J 3/407*** | (2006.01) |
| ***B41J 2/325*** | (2006.01) |
| ***B41J 33/14*** | (2006.01) |

(52) U.S. Cl.

CPC ..... *B41J 33/22* (2013.01); *B41J 2/325* (2013.01); *B41J 3/4075* (2013.01); *B41J 32/00* (2013.01); *B41J 33/14* (2013.01)

(58) Field of Classification Search

CPC . B41J 2/325; B41J 3/4075; B41J 32/00; B41J 33/14; B41J 33/22

See application file for complete search history.

(56) References Cited

U.S. PATENT DOCUMENTS

| | | | | |
|---|---|---|---|---|
| 4,762,434 | A * | 8/1988 | Hirano | B41J 33/22 74/354 |
| 10,118,404 | B2 * | 11/2018 | Sasaki | B41J 17/14 |
| 2005/0036812 | A1 * | 2/2005 | Carriere | B41J 33/44 400/218 |
| 2013/0195535 | A1 | 8/2013 | Kosuge et al. | |
| 2018/0264844 | A1 | 9/2018 | Sasaki | |

FOREIGN PATENT DOCUMENTS

| | | | |
|---|---|---|---|
| JP | S61-104877 | A | 5/1986 |
| JP | 2010-019339 | A | 1/2010 |
| JP | 2010-208805 | A | 9/2010 |
| JP | 2013-159409 | A | 8/2013 |
| JP | 2014-140927 | A | 8/2014 |
| JP | 2016-144875 | A | 8/2016 |

* cited by examiner

*Primary Examiner* — Jill E Culler
(74) *Attorney, Agent, or Firm* — Oliff PLC

(57) ABSTRACT

A ribbon transport mechanism includes an input gear that receives rotational power from a transport motor. An intermediate gear, which engages with the input gear, receives the rotational power from the transport motor via the input gear and transmits the rotational power to a first paying out rotor. When the cartridge is attached, a paying-out-side one-way clutch suppresses the input gear from rotating in a first input direction and the intermediate gear from rotating in a first intermediate direction and permits the input gear to rotate in a second input direction and the intermediate gear to rotate in a second intermediate direction. An elastic member applies force to the intermediate gear in the second intermediate direction to reserve a clearance between the input gear and the intermediate gear and next to a front end of the intermediate gear in the first intermediate direction.

11 Claims, 23 Drawing Sheets

RIBBON TRANSPORT MECHANISM AND TAPE PRINTING APPARATUS

The present application is based on, and claims priority from JP Application Serial Number 2019-051758, filed Mar. 19, 2019, the disclosure of which is hereby incorporated by reference herein in its entirety.

BACKGROUND

1. Technical Field

This application relates to a ribbon transport mechanism that transports an ink ribbon and a tape printing apparatus with the ribbon transport mechanism.

2. Related Art

JP-A-2013-159409 discloses a tape printing apparatuses equipped with a ribbon transport mechanism that transports an ink ribbon. This ribbon transport mechanism includes a paying-out-side clutch mechanism and a winding-side clutch mechanism. The paying-out-side clutch mechanism selectively transmits the rotational power generated by a drive motor to a paying-out-side drive shaft, whereas the winding-side clutch mechanism selectively transmits the rotational power to a winding-side drive shaft. Further, the paying-out-side clutch mechanism includes a paying-out-side sun gear and a paying-out-side planet gear; the paying-out-side planet gear engages with or is disengaged from a paying-out-side input gear while rotating and moving around the paying-out-side sun gear.

In a known tape printing apparatus as described above, after the paying-out-side drive shaft stops rotating and before the winding-side drive shaft starts rotating, the paying-out-side planet gear engages with the paying-out-side input gear, so that the drive motor is coupled to the paying-out-side drive shaft via the paying-out-side clutch mechanism. In this state, if a ribbon paying out core abuts against a paying-out-side drive shaft to disturb its rotation, the tape cartridge may be unable to be attached to the cartridge mount section.

SUMMARY

The disclosed embodiment is a ribbon transport mechanism provided in a tape printing apparatus. The ribbon transport mechanism includes a paying out rotor and a winding rotor. When a cartridge that includes a paying out core around which an ink ribbon is wound and a winding core that winds the ink ribbon paid out from the paying out core is attached to a cartridge mount section of the tape printing apparatus, the paying out rotor engages with the paying out core and the winding rotor engages with the winding core. The ribbon transport mechanism further includes a transport motor that generates rotational power and a transport gear train that transmits the rotational power from the transport motor to the paying out rotor. The transport gear train includes an input gear, an intermediate gear, a clutch mechanism, and an elastic member. The input gear receives the rotational power from the transport motor. The intermediate gear, which engages with the input gear, receives the rotational power from the transport motor via the input gear and transmits the received rotational power to the paying out rotor. When the cartridge is attached, the clutch mechanism suppresses the input gear from rotating in a first input direction and the intermediate gear from rotating in a first intermediate direction and permits the input gear to rotate in a second input direction and the intermediate gear to rotate in a second intermediate direction; the second input direction is opposite to the first input direction, and the second intermediate direction is opposite to the first intermediate direction. The elastic member applies force to the intermediate gear in the second intermediate direction to reserve a clearance between the input gear and the intermediate gear and next to a front end of the intermediate gear in the first intermediate direction.

The present disclosure is a tape printing apparatus to which a cartridge is to be attached. The cartridge includes a paying out core around which an ink ribbon is wound and a winding core that winds the ink ribbon paid out from the paying out core. The tape printing apparatus includes a cartridge mount section to which the cartridge is to be attached. A paying out rotor, when the cartridge is attached to the cartridge mount section, engages with the paying out core. A winding rotor, when the cartridge is attached to the cartridge mount section, engages with the winding core. A transport motor generates rotational power. A transport gear train transmits the rotational power from the transport motor to the paying out rotor. A printing head performs a printing operation on a print tape. A transport gear train includes an input gear, an intermediate gear, a clutch mechanism, and an elastic member. The input gear receives the rotational power from the transport motor. The intermediate gear, which engages with the input gear, receives the rotational power from the transport motor via the input gear and transmits the received rotational power to the paying out rotor. When the cartridge is attached, the clutch mechanism suppresses the input gear from rotating in a first input direction and the intermediate gear from rotating in a first intermediate direction and permits the input gear to rotate in a second input direction and the intermediate gear to rotate in a second intermediate direction; the second input direction is opposite to the first input direction, and the second intermediate direction is opposite to the first intermediate direction. The elastic member applies force to the intermediate gear in the second intermediate direction to reserve a clearance between the input gear and the intermediate gear and next to a front end of the intermediate gear in the first intermediate direction.

DESCRIPTION OF EXEMPLARY EMBODIMENTS

With reference to the accompanying drawings, a description will be given below of a tape printing apparatus 1 according to some embodiments of the present disclosure. These drawings employ an X-Y-Z orthogonal coordinate system, but it should be noted that this coordinate system is used for the sake of the explanation and thus not intended to limit embodiments that will be described below. Furthermore, the number and numeric values of individual components are examples and thus not intended to limit the embodiments.

Outline of Tape Printing Apparatus, Tape Cartridge, and Ribbon Cartridge

Figure 1:
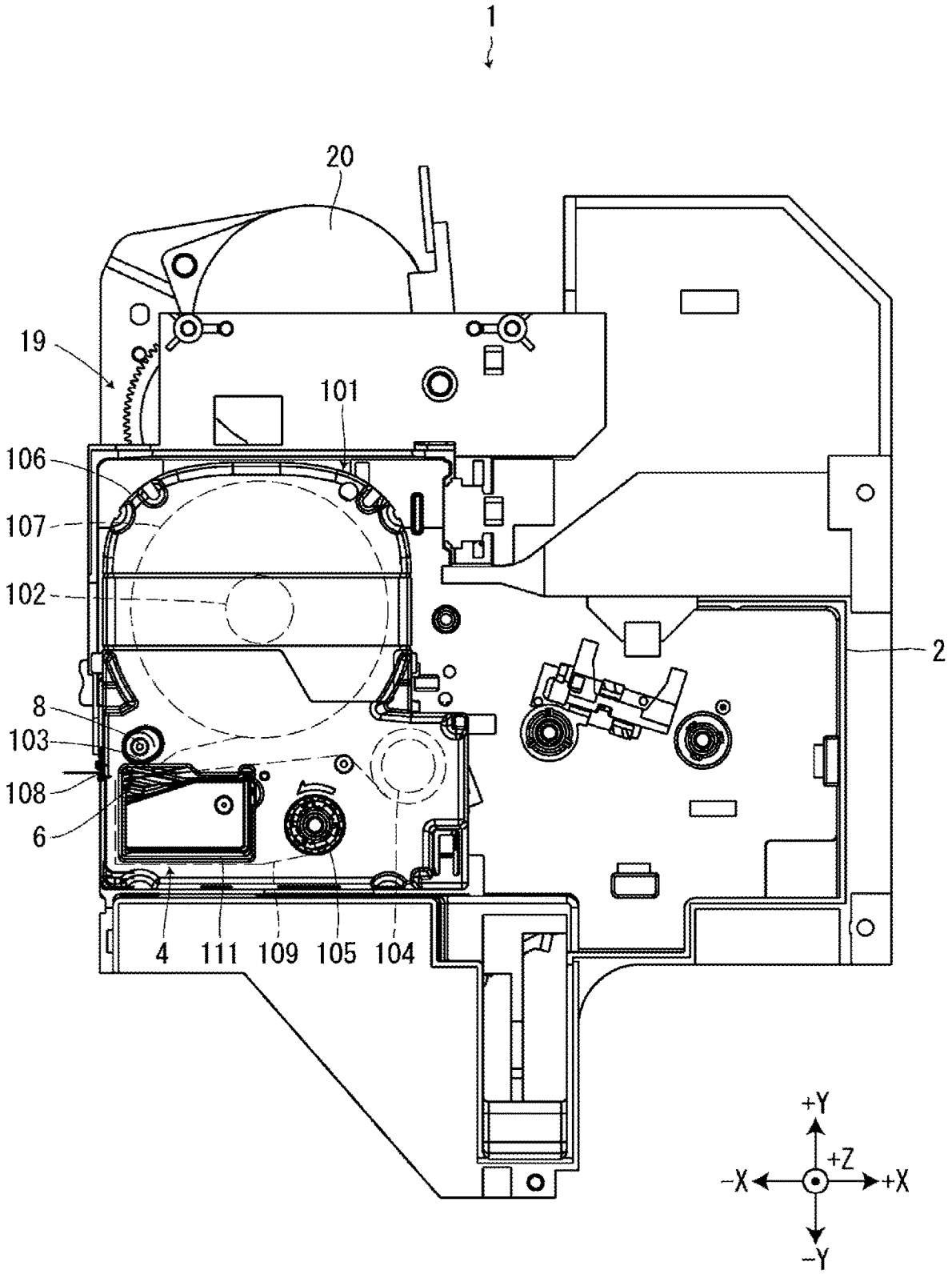
FIG. 1 illustrates a tape printing apparatus in which a tape cartridge is attached to a cartridge mount section, as viewed from an attachment direction.
Figure 2:
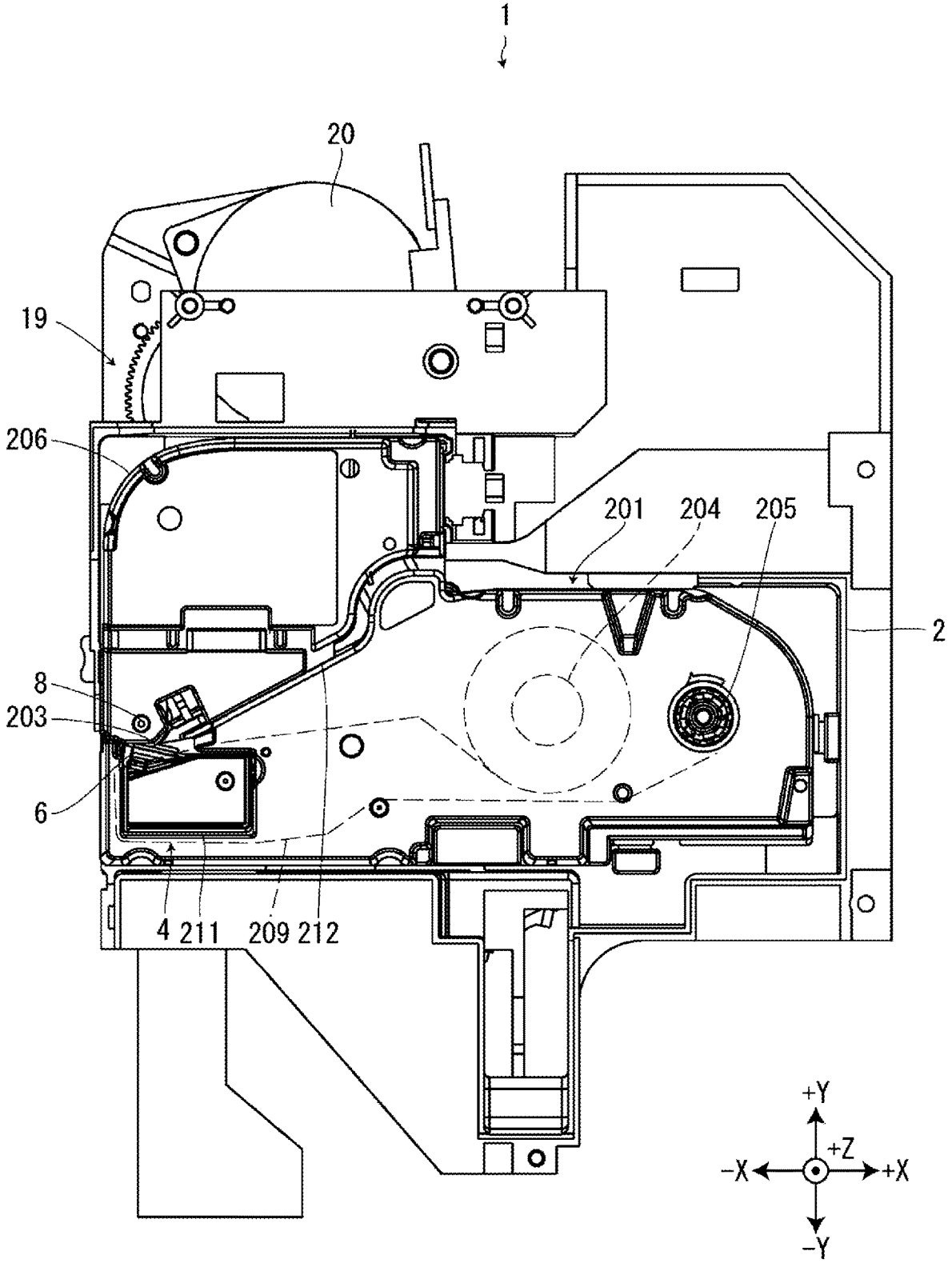
FIG. 2 illustrates the tape printing apparatus in which a ribbon cartridge is attached to the cartridge mount section, as viewed from the attachment direction.
Figure 3:
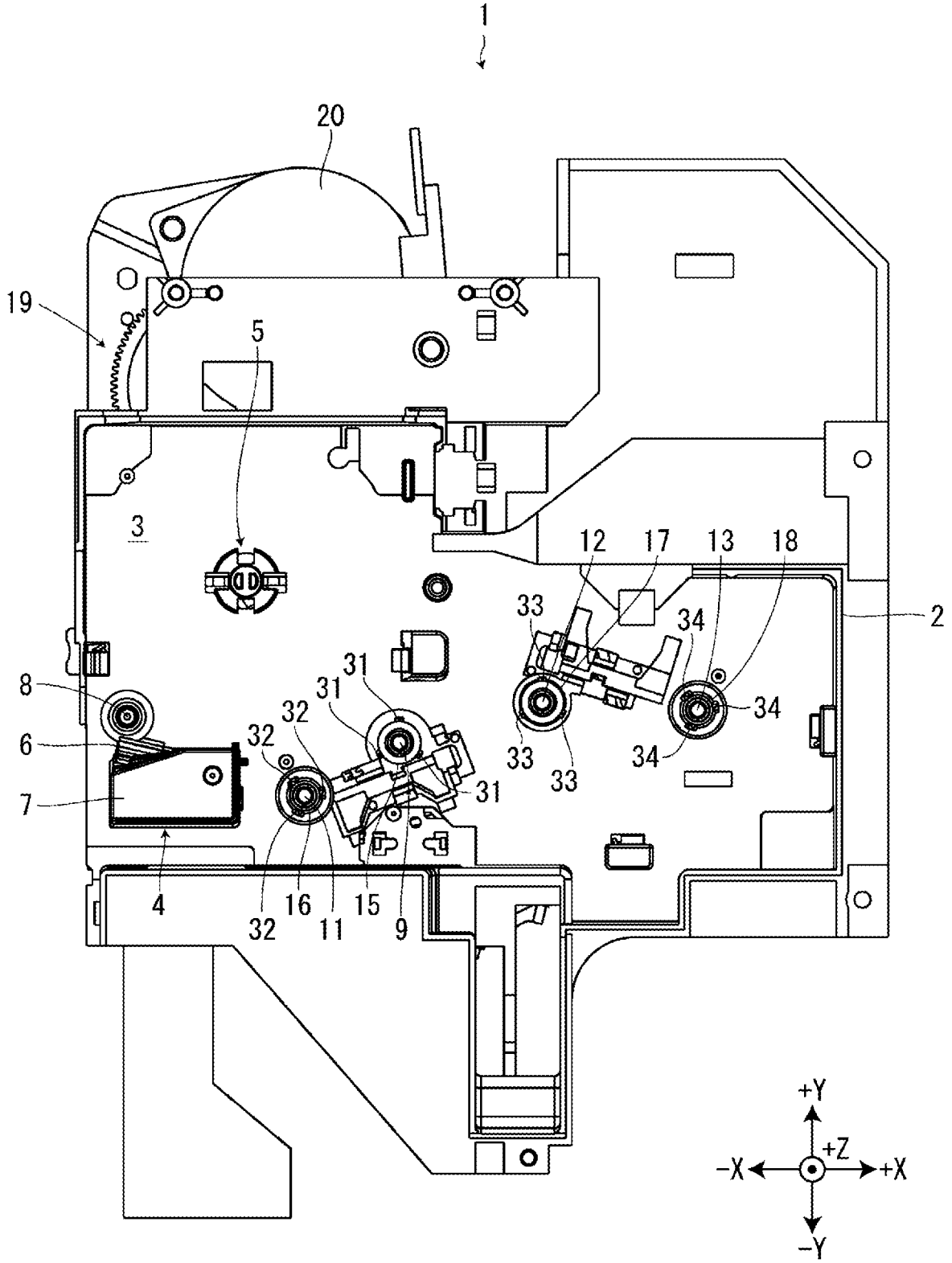
FIG. 3 illustrates the tape printing apparatus in which neither the tape cartridge nor the ribbon cartridge is attached to the cartridge mount section, as viewed from the attachment direction.

Referring to FIGS. 1 to 3, the tape printing apparatus 1 includes a cartridge mount section 2 to which a tape cartridge 101 and a ribbon cartridge 201 are to be selectively attached. In addition, the tape printing apparatus 1 further includes an unillustrated mount section cover that covers or exposes the cartridge mount section 2.

As illustrated in FIG. 1, the tape cartridge 101 includes a tape core 102, a first platen roller 103, a first paying out core 104, a first winding core 105, and a first cartridge case 106. Wound around the tape core 102 is a first print tape 107, which is to be paid out from the tape core 102 to the outside of the first cartridge case 106 via a tape outlet 108. The tape outlet 108 is disposed on the −X-side surface of the outer wall of the first cartridge case 106. Wound around the first paying out core 104 is a first ink ribbon 109, which is to be paid out from the first paying out core 104 to the first winding core 105 and wound around the first winding core 105. The first cartridge case 106, which forms the exterior of the tape cartridge 101, contains the tape core 102, the first platen roller 103, the first paying out core 104, the first winding core 105, the first print tape 107, and the first ink ribbon 109. The first cartridge case 106 has a first head insertion hole 111 that penetrates the first cartridge case 106 along the Z axis.

As illustrated in FIG. 2, the ribbon cartridge 201 includes a second platen roller 203, a second paying out core 204, a second winding core 205, and a second cartridge case 206. Wound around the second paying out core 204 is a second ink ribbon 209, which is to be paid out from the second paying out core 204 to the second winding core 205 and wound around the second winding core 205. The second cartridge case 206, which forms the exterior of the ribbon cartridge 201, contains the second platen roller 203, the second paying out core 204, the second winding core 205, and the second ink ribbon 209. The second cartridge case 206 has a second head insertion hole 211 that penetrates the second cartridge case 206. The second cartridge case 206 is provided with a second tape route 212. Furthermore, an unillustrated tape roller around which a second print tape is wound is disposed outside the tape printing apparatus 1 and introduces the second print tape to the second tape route 212.

The second print tape around the tape roller and the second ink ribbon 209 contained in the ribbon cartridge 201 may have any given initial lengths. In this embodiment, the second print tape may be greater in initial length than the first print tape 107 contained in the tape cartridge 101. Likewise, the second ink ribbon 209 may be greater in initial length than the first ink ribbon 109 contained in the tape cartridge 101. For example, if the tape printing apparatus 1 prints many labels at one time, the ribbon cartridge 201 is typically attached to the cartridge mount section 2.

Figure 4:
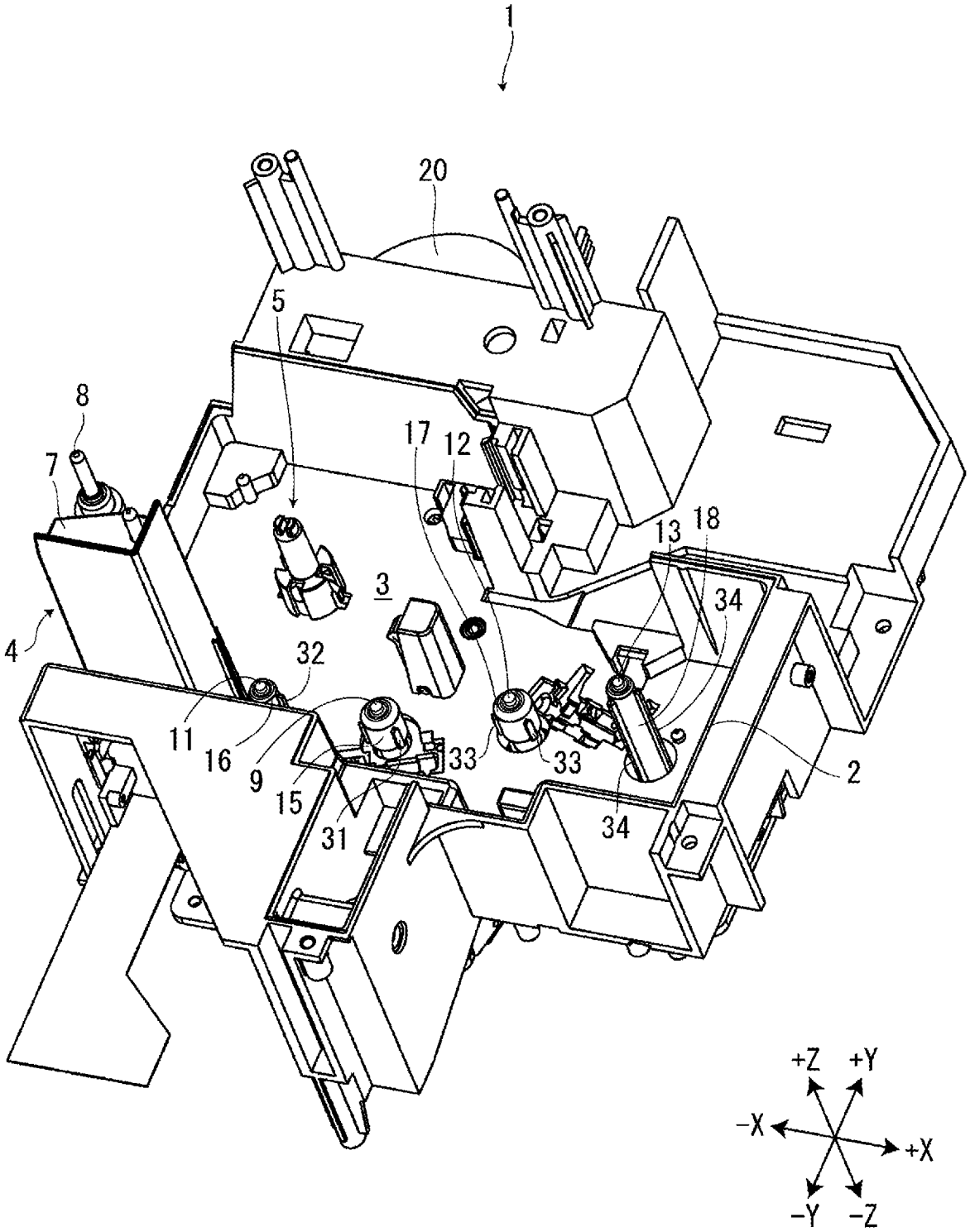
FIG. 4 illustrates, in perspective, the tape printing apparatus in which neither the tape cartridge nor the ribbon cartridge is attached to the cartridge mount section.

As illustrated in FIGS. 3 and 4, the cartridge mount section 2 has a recess that is open toward the +Z-side, and a head section 4 and a core projection 5 are disposed on a mount bottom surface 3 of this recess while protruding in the direction opposite to the attachment direction of the cartridge mount section 2. The head section 4 includes a printing head 6 and a head cover 7 that covers at least +X-, −Y-, and +Z-side surfaces of the printing head 6. In one embodiment, the printing head 6 may be a thermal head with a heater element. When the tape cartridge 101 is attached to the cartridge mount section 2, the head cover 7 is inserted into the first head insertion hole 111 and guides the attaching of the tape cartridge 101. Likewise, when the ribbon cartridge 201 is attached to the cartridge mount section 2, the head cover 7 is inserted into the second head insertion hole 211 and guides the attaching of the ribbon cartridge 201. In addition, when the tape cartridge 101 is attached to the cartridge mount section 2, the core projection 5 is accommodated in an unillustrated core recess provided in the tape cartridge 101.

Disposed on the mount bottom surface 3 are a platen shaft 8, a first winding shaft 11, a first paying out shaft 9, a second paying out shaft 12, and a second winding shaft 13 so as to be arranged in this order from the −X-side to the +X-side while protruding toward the +Z-side.

The platen shaft 8 is disposed close to the +Y-side surface of the printing head 6 while protruding in the direction opposite to the attachment direction. The protrusion of the platen shaft 8 is greater in amount than any of the first paying out shaft 9, the first winding shaft 11, the second paying out shaft 12, and the second winding shaft 13. When the tape cartridge 101 is attached to the cartridge mount section 2, the platen shaft 8 is inserted into the first platen roller 103 and guides the attaching of the tape cartridge 101 together with the head cover 7. Likewise, when the ribbon cartridge 201 is attached to the cartridge mount section 2, the platen shaft 8 is inserted into the second platen roller 203 and guides the attaching of the ribbon cartridge 201 together with the head cover 7. Hereinafter, the direction in which the tape cartridge 101 or the ribbon cartridge 201 is attached is referred to as the attachment direction. The attachment direction is parallel to the direction in which the platen shaft 8 protrudes or the Z axis. In this case, the attachment direction corresponds to the direction toward the −Z-side, whereas the direction opposite to the attachment direction corresponds to the direction toward the +Z-side.

The platen shaft 8 rotatably supports a platen rotor 14 (see FIG. 8); the first paying out shaft 9 rotatably supports a first paying out rotor 15; the first winding shaft 11 rotatably supports a first winding rotor 16; the second paying out shaft 12 rotatably supports a second paying out rotor 17; and the second winding shaft 13 rotatably supports a second winding rotor 18. When the tape cartridge 101 is attached to the cartridge mount section 2, the platen rotor 14 is inserted into and engages with the first platen roller 103, the first paying out rotor 15 is inserted into and engages with the first paying out core 104, and the first winding rotor 16 is inserted into and engages with the first winding core 105. Likewise, when the ribbon cartridge 201 is attached to the cartridge mount section 2, the platen rotor 14 is inserted into and engages with the second platen roller 203, the second paying out rotor 17 is inserted into and engages with the second paying out core 204, and the second winding rotor 18 is inserted into and engages with the second winding core 205. Each of the platen rotor 14, the first paying out rotor 15, the first winding rotor 16, the second paying out rotor 17, and the second winding rotor 18 receives the rotational power from a transport motor 20 via a transport gear train 19 that will be described later. Herein, the mechanism constituted by at least the first paying out rotor 15, the first winding rotor 16, the second paying out rotor 17, the second winding rotor 18, the transport gear train 19, and the transport motor 20 corresponds to an example of a "ribbon transport mechanism".

Provided on the outer circumference of the first paying out rotor 15 are three first-paying-out-rotor-side engaging projections 31, which are arranged at substantially equal intervals on the outer circumference. Likewise, provided on the outer circumference of the first winding rotor 16 are three first-winding-rotor-side engaging projections 32, which are arranged at substantially equal intervals on the outer circumference. Provided on the outer circumference of the second paying out rotor 17 are three second-paying-out-rotor-side engaging projections 33, which are arranged at substantially equal intervals on the outer circumference. Likewise, provided on the outer circumference of the second winding rotor 18 are three second-winding-rotor-side engaging projections 34, which are arranged at substantially equal intervals on the outer circumference. Furthermore, provided on the outer circumference of the platen rotor 14 are three unillustrated platen-shaft-rotor-side engaging projections.

Figure 5:
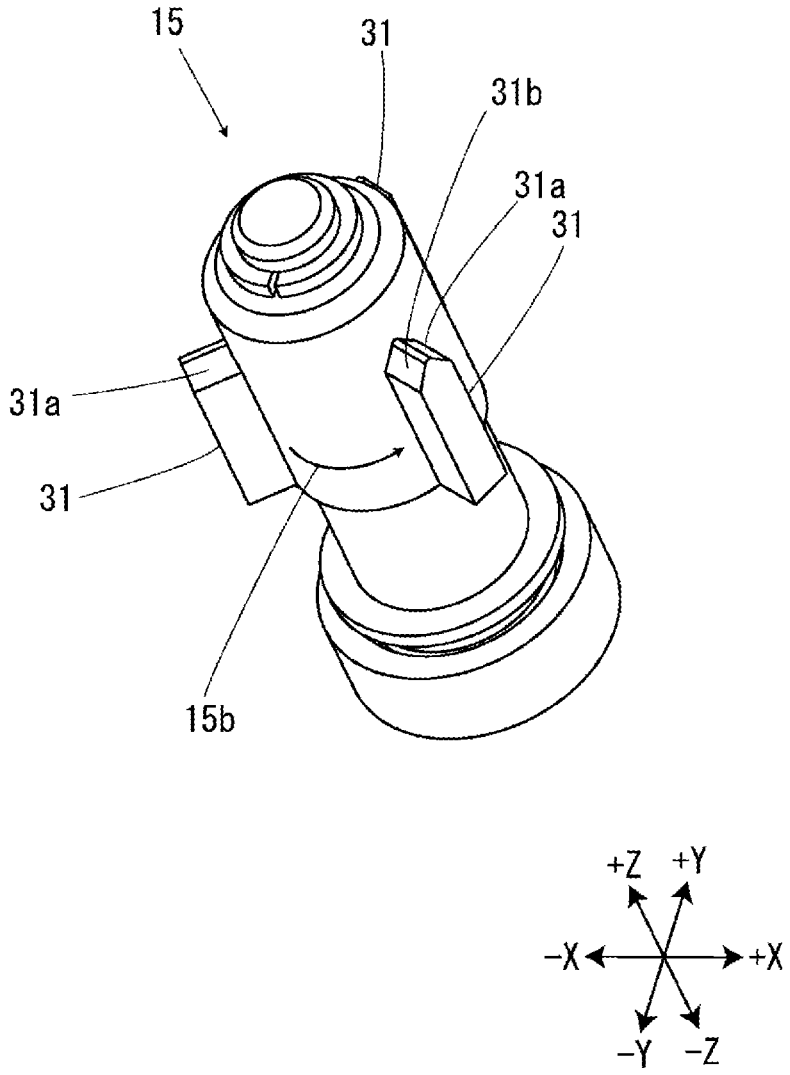
FIG. 5 illustrates the first paying out rotor in perspective.

As illustrated in FIG. 5, each of the first-paying-out-rotor-side engaging projections 31 is formed into a substantially quadrangular prism shape that is elongated in parallel to the axis of the first paying out rotor 15. In addition, each first-paying-out-rotor-side engaging projection 31 has a front surface, as viewed from the attachment direction, that is chamfered at two corners. More specifically, the front surface is provided with a first front engagement slope 31*a* and a first rear engagement slope 31*b*. When the first paying out rotor 15 rotates in a second paying out direction 15*b*, the first front engagement slope 31*a* is positioned ahead of the first rear engagement slope 31*b* in the second paying out direction 15*b*. The second paying out direction 15*b* corresponds to the direction (see FIG. 9) in which the first paying out rotor 15 rotates in conjunction with the rotation of the transport motor 20 in a second motor direction 20*b*. When the first paying out rotor 15 rotates in the second paying out direction 15*b*, the first ink ribbon 109 is wound around the first paying out core 104. Details of this will be described later. The configuration, described above, of the first-paying-out-rotor-side engaging projections 31 is similar to an unillustrated configuration of the second-paying-out-rotor-side engaging projections 33. Further, the front surface of each of the second-paying-out-rotor-side engaging projections 33 as viewed from the attachment direction is also provided with a second front engagement slope and a second rear engagement slope.

Figure 6:
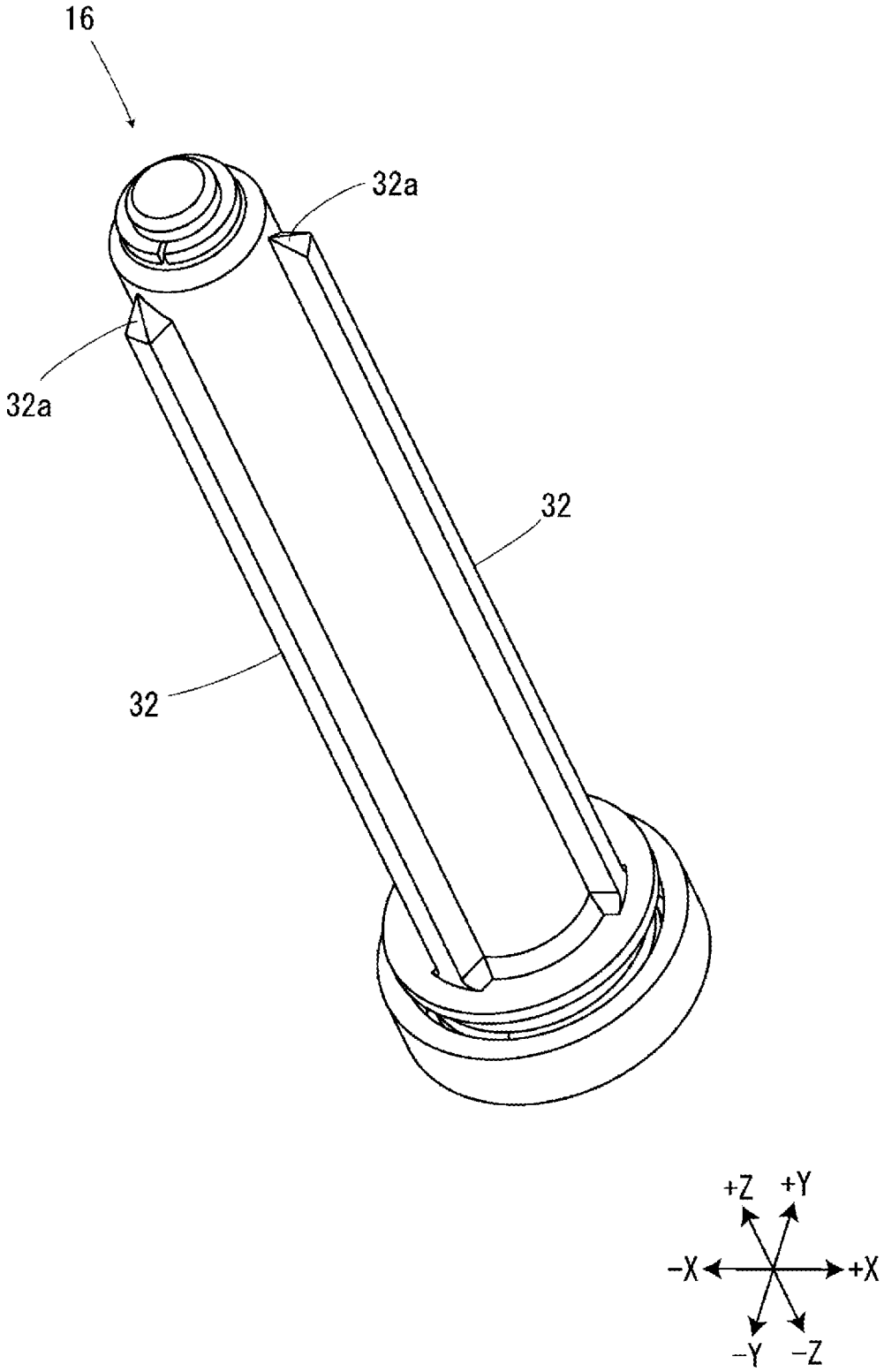
FIG. 6 illustrates the first winding rotor in perspective.

As illustrated in FIG. 6, each of the first-winding-rotor-side engaging projections 32 in the first winding rotor 16 is formed into a narrow, substantially quadrangular prism shape, which is elongated in parallel to the axis of the first winding rotor 16. The rear surface of each first-winding-rotor-side engaging projection 32 as viewed from the attachment direction is referred to as a first-winding-rotor-side engaging end 32*a*, which is formed into a sharp shape. The configuration, described above, of the first-winding-rotor-side engaging projections 32 is similar to an unillustrated configuration of the second-winding-rotor-side engaging projections 34. Further, the front surface of each second-winding-rotor-side engaging projection 34 as viewed from the attachment direction is also provided with a second-winding-rotor-side engaging end.

Transport Gear Train

Figure 7:
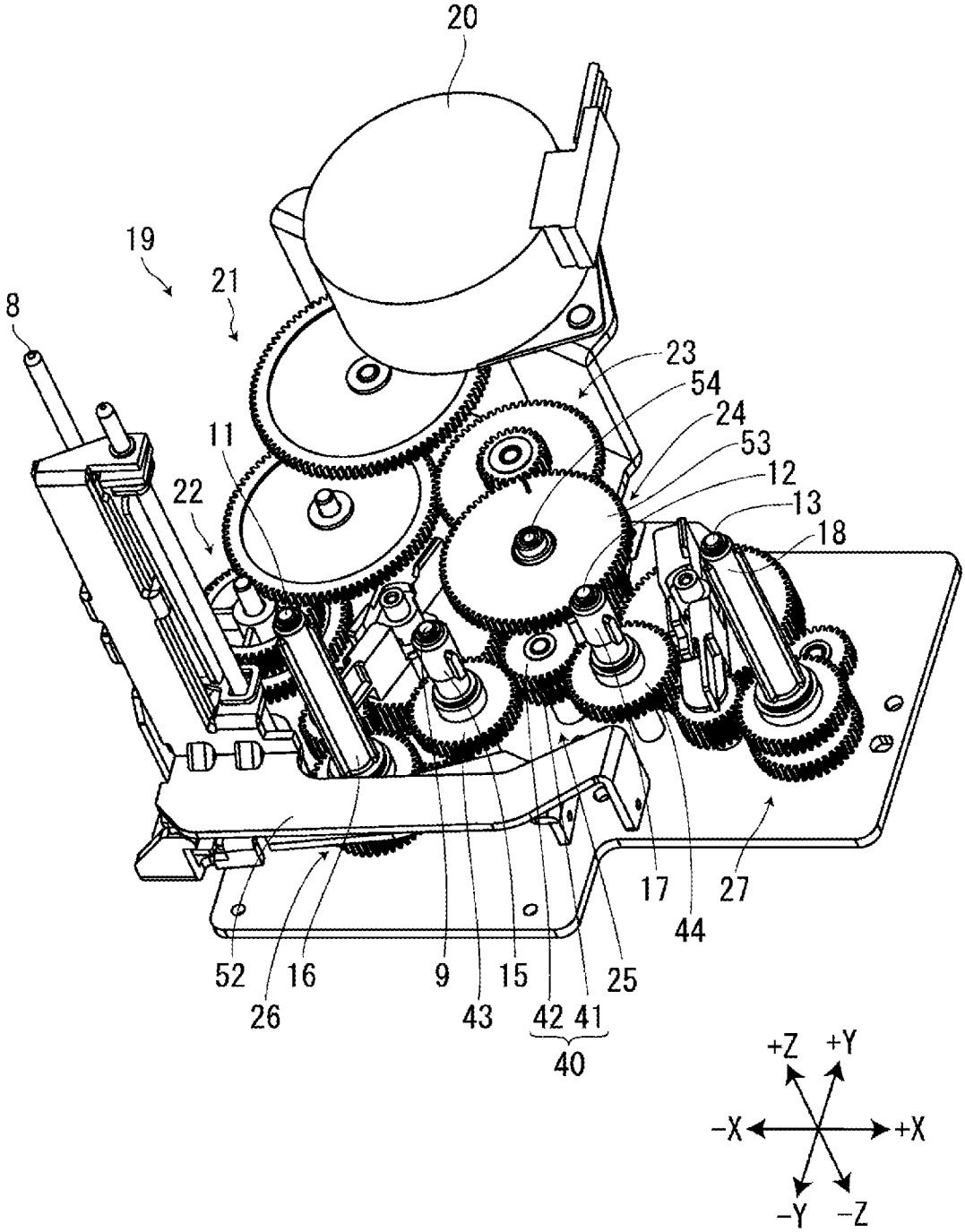
FIG. 7 illustrates the transport gear train in perspective.
Figure 8:
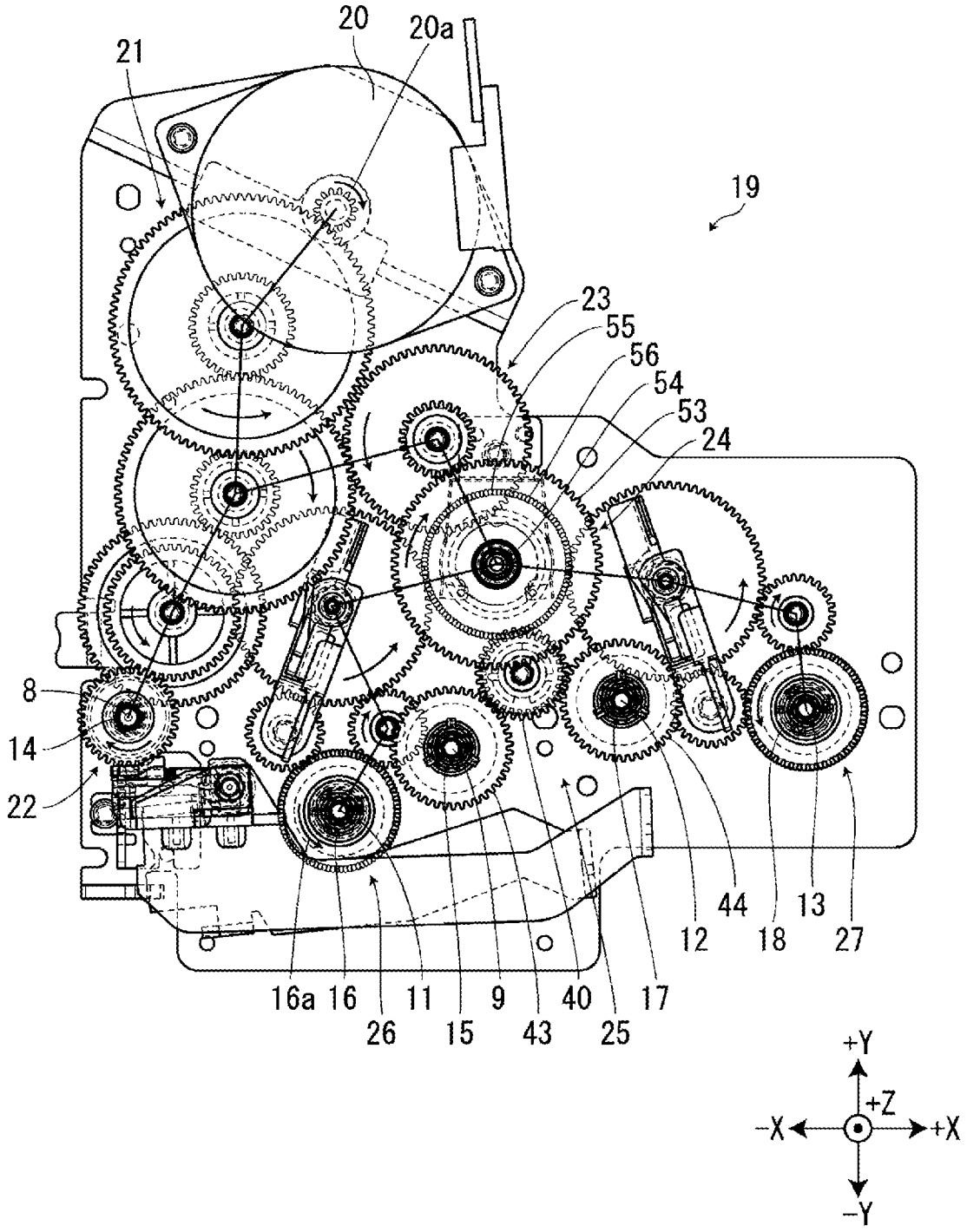
FIG. 8 illustrates the transport gear train as viewed from the attachment direction; the directions in which the individual gears and rotors in the transport gear train rotate in conjunction with the rotation of the transport motor in a first motor direction are denoted by the arrows.
Figure 9:
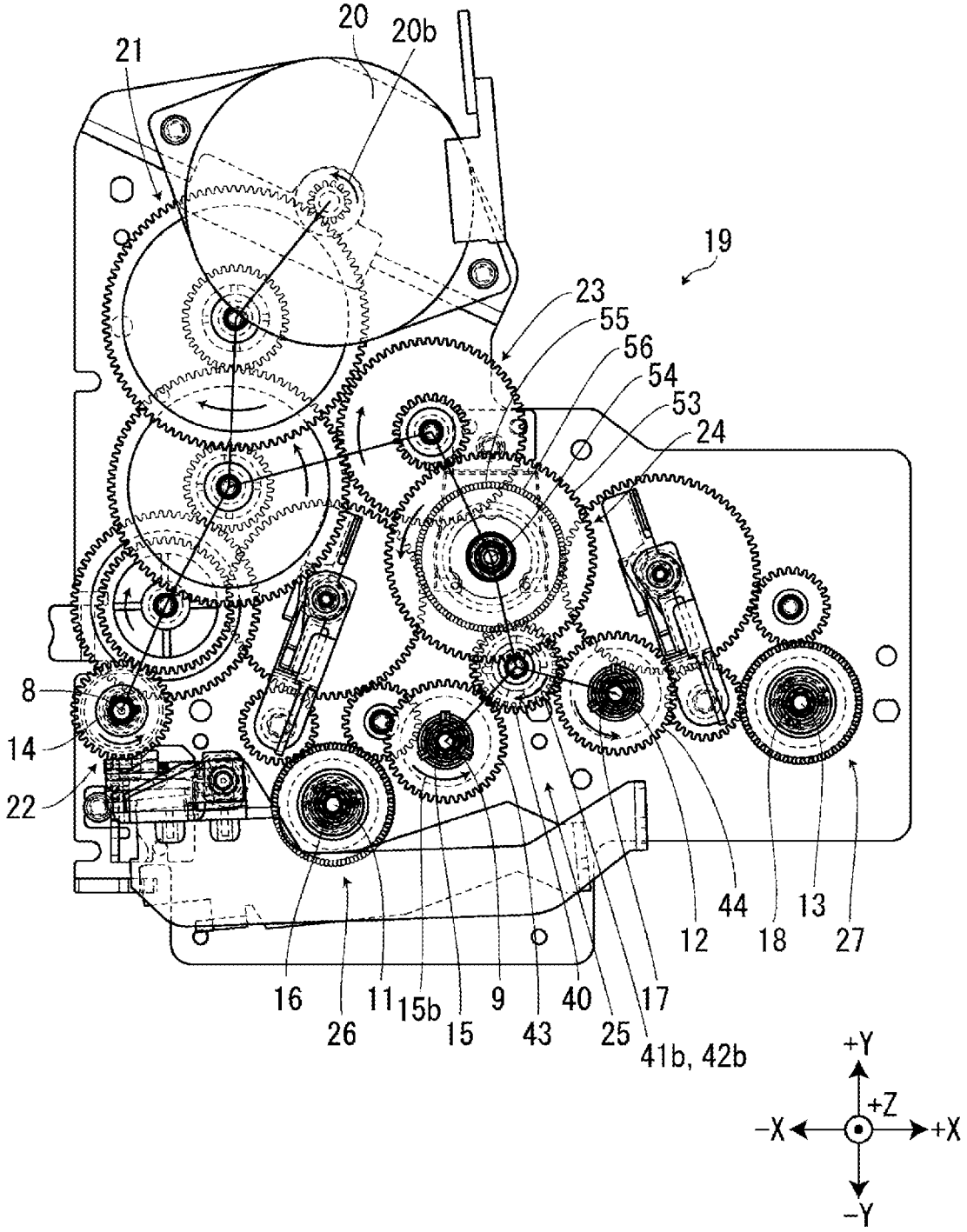
FIG. 9 illustrates the transport gear train as viewed from the attachment direction; the directions in which the individual gears and rotors in the transport gear train rotate in conjunction with the rotation of the transport motor in a second motor direction are denoted by the arrows.

Referring to FIGS. 7 to 9, the tape printing apparatus 1 further includes a transport gear train 19. The transport gear train 19 includes a motor-side gear train 21, a platen-side gear train 22, a ribbon-side gear train 23, a one-way clutch unit 24, a paying-out-side gear train 25, a first winding-side gear train 26, and a second winding-side gear train 27.

The motor-side gear train 21 transmits the rotational power generated by the transport motor 20 to both the platen-side gear train 22 and the ribbon-side gear train 23. When receiving the rotational power from the transport motor 20 via the motor-side gear train 21, the platen-side gear train 22 transmits the received rotational power to the platen rotor 14. When receiving the rotational power from the transport motor 20 via the motor-side gear train 21, the ribbon-side gear train 23 transmits the received rotational power to the one-way clutch unit 24.

When receiving the rotational power from the transport motor 20 via the ribbon-side gear train 23, the one-way clutch unit 24 selectively transmits the received rotational power to one or more of the paying-out-side gear train 25, the first winding-side gear train 26, and the second winding-side gear train 27, depending on in which direction the transport motor 20 rotates. More specifically, when the transport motor 20 rotates in a first motor direction 20*a*, namely, in a clockwise direction as illustrated in FIG. 8, the one-way clutch unit 24 receives the rotational power from the transport motor 20 and transmits the received rotational power to both the first winding-side gear train 26 and the second winding-side gear train 27. When the transport motor 20 rotates in the second motor direction 20*b*, which is opposite to the first motor direction 20*a*, namely, in a counterclockwise direction as illustrated in FIG. 9, the one-way clutch unit 24 receives the rotational power from the transport motor 20 and transmits the received rotational power to the paying-out-side gear train 25. Herein, the clockwise and counterclockwise directions correspond to those as viewed from the attachment direction. Details of the configuration of the one-way clutch unit 24 will be described later.

When receiving the rotational power from the transport motor 20 via the one-way clutch unit 24, the paying-out-side gear train 25 transmits the received rotational power to both the first paying out rotor 15 and the second paying out rotor 17. The paying-out-side gear train 25 includes an input gear 41 and an intermediate gear 42, both of which constitute a twin gear 40; the input gear 41 engages with the paying-out-side one-way clutch 55, details of which will be described later, and the intermediate gear 42 is positioned in front of the input gear 41 in the attachment direction and engages with the input gear 41. The paying-out-side gear train 25 further includes a first output gear 43 and a second output gear 44; the first output gear 43 is positioned on the −X-side of the intermediate gear 42 and engages with the intermediate gear 42, and the second output gear 44 is positioned on the +X-side of the intermediate gear 42 and engages with the intermediate gear 42. The first output gear 43 is coupled to the first paying out rotor 15 so as to be rotatable around the first paying out shaft 9. The second output gear 44 is coupled to the second paying out rotor 17 so as to be rotatable around the second paying out shaft 12. Details of the configuration of the twin gear 40 will be described later.

When receiving the rotational power from the transport motor 20 via the one-way clutch unit 24, the first winding-side gear train 26 transmits the received rotational power to the first winding rotor 16. When receiving the rotational power from the transport motor 20 via the one-way clutch unit 24, the second winding-side gear train 27 transmits the received rotational power to the second winding rotor 18.

When the transport motor 20 rotates in the first motor direction 20*a* as illustrated in FIG. 8, the individual gears constituting the transport gear train 19 rotate in respective directions, which are referred to as first directions of the individual gears. When the transport motor 20 rotates in the second motor direction 20*b* as illustrated in FIG. 9, the individual gears constituting the transport gear train 19 rotate in respective opposite directions, which are referred to as second directions of the individual gears. In this case, the second direction of the input gear 41 is referred to as a second input direction 41*b*, whereas the second direction of the intermediate gear 42 is referred to as a second intermediate direction 42*b*. Both of the second input direction 41*b* and the second intermediate direction 42*b* correspond to the clockwise direction, as illustrated in FIG. 9. The second intermediate direction 42*b* is opposite to a first intermediate direction 42*a* (see FIG. 17).

When the transport motor 20 rotates in the first motor direction 20*a* as illustrated in FIG. 8, the platen rotor 14, the first winding rotor 16, and the second winding rotor 18 rotate in respective directions, which are first directions of the individual rotors. In this case, the first direction of the first winding rotor 16 is referred to as a first winding direction 16*a*, which corresponds to the counterclockwise direction as illustrated in FIG. 8. Likewise, when the transport motor 20 rotates in the second motor direction 20*b* as illustrated in FIG. 9, the platen rotor 14, the first paying out rotor 15, and the second paying out rotor 17 rotate in respective other directions, which are second directions of the individual rotors. In this case, the second direction of the first paying out rotor 15 is referred to a second paying out direction 15*b*, which corresponds to the clockwise direction as illustrated in FIG. 9. The second paying out direction 15*b* is opposite to a first paying out direction 15*a* (see FIG. 17).

Printing Process Performed with Tape Cartridge Attached

When the tape cartridge 101 is attached to the cartridge mount section 2 of the tape printing apparatus 1 as illustrated in FIG. 1, the first platen roller 103 in the tape cartridge 101 engages with the platen rotor 14 in the cartridge mount section 2 as illustrated in FIG. 3, the first paying out core 104 in the tape cartridge 101 engages with the first paying out rotor 15 in the cartridge mount section 2, and the first winding core 105 in the tape cartridge 101 engages with the first winding rotor 16 in the cartridge mount section 2. As a result, the transport motor 20 can transmit its rotational power to the first platen roller 103, the first paying out core 104, and the first winding core 105.

In addition to the above, the head section 4 in the cartridge mount section 2 is inserted into the first head insertion hole 111 in the tape cartridge 101. Then, the mount section cover is attached to the cartridge mount section 2, after which a head moving mechanism 52 (see FIG. 7) moves the printing head 6 to the platen shaft 8, thereby nipping both the first print tape 107 and the first ink ribbon 109 between the printing head 6 and the first platen roller 103.

Following the above, when the transport motor 20 rotates in the first motor direction 20*a*, the rotational power generated by the transport motor 20 is transmitted to both the platen rotor 14 and the first winding rotor 16 via the transport gear train 19. As a result, the first platen roller 103 rotates in a feeding direction, and the first winding core 105 rotates in a winding direction. Herein, the expression "the first platen roller 103 rotates in a feeding direction" means that the first platen roller 103 rotates in such a way that the first print tape 107 is fed to the tape outlet 108 and that the first ink ribbon 109 is paid out from the first paying out core 104 to the first winding core 105. The expression "the first winding core 105 rotates in a winding direction" means that the first winding core 105 rotates in such a way that the first ink ribbon 109 paid out from the first paying out core 104 is wound around the first winding core 105. In this case, the first platen roller 103 rotates in the clockwise direction, and the first winding core 105 rotates in the counterclockwise direction as in the example of FIG. 1.

When the transport motor 20 rotates in the second motor direction 20*b*, the rotational power generated by the transport motor 20 is transmitted to both the platen rotor 14 and the first paying out rotor 15 via the transport gear train 19. As a result, the first platen roller 103 rotates in a reverse direction, and the first paying out core 104 rotates in a rewinding direction. Herein, the expression "the first platen roller 103 rotates in a reverse direction" means that the first print tape 107 is fed back from the tape outlet 108 to the first print tape 107 and that the first ink ribbon 109 is fed back from the first winding core 105 to the first paying out core 104. The expression "the first paying out core 104 rotates in a rewinding direction" means that the first ink ribbon 109 paid out from the first paying out core 104 is rewound around the first paying out core 104. In this case, both the first platen roller 103 and the first paying out core 104 rotate in the counterclockwise direction as in the example of FIG. 1.

The tape printing apparatus 1 rotates the transport motor 20 in the first motor direction 20*a* and heats the printing head 6. Then, the tape printing apparatus 1 prints information that has been received via an input device, such as a keyboard, on a predetermined portion of the first print tape 107 while feeding both the first print tape 107 and the first ink ribbon 109. After having printed the information, the tape printing apparatus 1 uses an unillustrated cutter disposed between the cartridge mount section 2 and a tape ejection hole to cut the portion off the first print tape 107. Then, the tape printing apparatus 1 rotates the transport motor 20 in the second motor direction 20*b*, thereby feeding back the first print tape 107 until its end is positioned close to a predetermined site between the printing head 6 and the first platen roller 103. In this way, the tape printing apparatus 1 successfully minimizes a margin of the first print tape 107 at its forward end which is to be used for the next printing.

The tape printing apparatus 1 also performs the printing operation in the same manner when the ribbon cartridge 201 is attached to the cartridge mount section 2. In short, the tape printing apparatus 1 prints information on the second print tape while feeding both the second print tape and the second ink ribbon 209 between the printing head 6 and the second platen roller 203.

One-Way Clutch Unit

Figure 10:
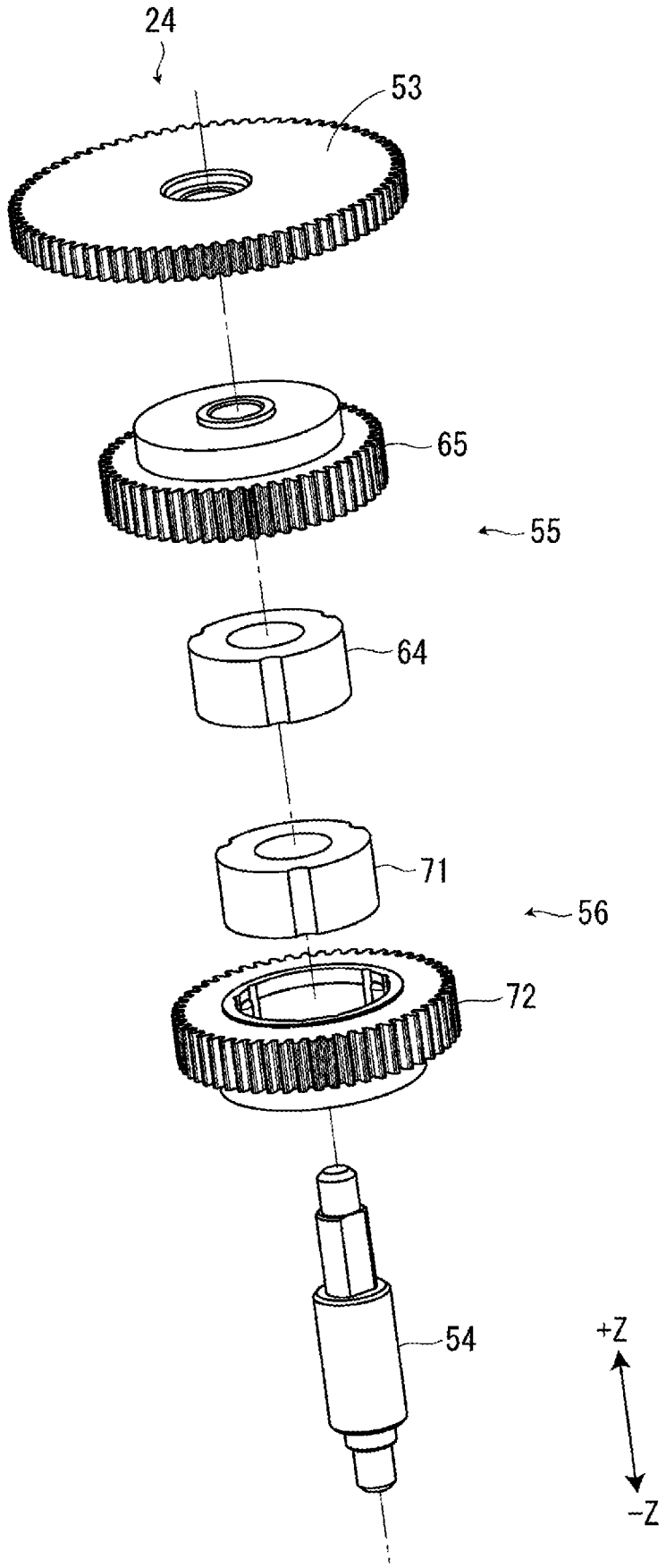
FIG. 10 is an exploded, perspective view of the one-way clutch unit.

Referring to FIG. 10, the one-way clutch unit 24 includes a drive gear 53, a clutch shaft 54, a paying-out-side one-way clutch 55, and a winding-side one-way clutch 56. Herein, the paying-out-side one-way clutch 55 corresponds to an example of a "clutch mechanism".

Since the drive gear 53 engages with the gear in the ribbon-side gear train 23 (see FIG. 8), the drive gear 53 receives the rotational power from the transport motor 20 via the ribbon-side gear train 23.

The clutch shaft 54 rotates together with the drive gear 53 and transmits the rotational power from the drive gear 53 to both the paying-out-side one-way clutch 55 and the winding-side one-way clutch 56.

The paying-out-side one-way clutch 55 includes a feeding-side inner ring member 64 and a paying-out-side outer ring member 65. The clutch shaft 54 is fitted into the paying-out-side inner ring member 64 so that both the clutch shaft 54 and the paying-out-side inner ring member 64 rotate together. The paying-out-side outer ring member 65 is disposed on the outer circumference of the paying-out-side inner ring member 64 and engages with an input gear 41 that will be described later.

When the drive gear 53 rotates in the first direction, the paying-out-side inner ring member 64 rotates in the first direction, but the paying-out-side outer ring member 65 does not rotate. In other words, the paying-out-side inner ring member 64 rotates at idle. This is because the paying-out-side inner ring member 64 does not engage with the paying-out-side outer ring member 65 so that the torque of the paying-out-side inner ring member 64 is suppressed from being transmitted to the paying-out-side outer ring member 65. When the drive gear 53 rotates in the second direction, both the paying-out-side inner ring member 64 and the paying-out-side outer ring member 65 rotate together in the second direction. This is because the paying-out-side inner ring member 64 engages with the paying-out-side outer ring member 65 so that the torque of the paying-out-side inner ring member 64 is permitted to be transmitted to the paying-out-side outer ring member 65. In short, when the transport motor 20 rotates in the first motor direction 20*a* as illustrated in FIG. 8, the paying-out-side one-way clutch 55 receives the rotational power from the transport motor 20 via the drive gear 53 but suppresses the received rotational power from being transmitted to the paying-out-side gear train 25. When the transport motor 20 rotates in the second motor direction 20*b* as illustrated in FIG. 9, the paying-out-side one-way clutch 55 receives the rotational power from the transport motor 20 via the drive gear 53 and permits the received rotational power to be transmitted to the paying-out-side gear train 25. It should be noted that the paying-out-side inner ring member 64 does not necessarily have to be configured to receive the rotational power from the transport motor 20. Alternatively, the paying-out-side outer ring member 65 may be configured to receive the rotational power.

The configuration, described above, of the paying-out-side one-way clutch 55 is similar to that of the winding-side one-way clutch 56. The winding-side one-way clutch 56 includes a winding-side inner ring member 71 and a winding-side outer ring member 72. When the transport motor 20 rotates in the first motor direction 20*a* as illustrated in FIG. 8, the winding-side one-way clutch 56 receives the rotational power from the transport motor 20 via the drive gear 53 and permits the received rotational power to be transmitted to both the first winding-side gear train 26 and the second winding-side gear train 27. When the transport motor 20 rotates in the second motor direction 20*b* as illustrated in FIG. 9, the winding-side one-way clutch 56 receives the rotational power from the transport motor 20 via the drive gear 53 and suppresses the received rotational power from being transmitted to both the first winding-side gear train 26 and the second winding-side gear train 27.

Twin Gear

Figure 11:
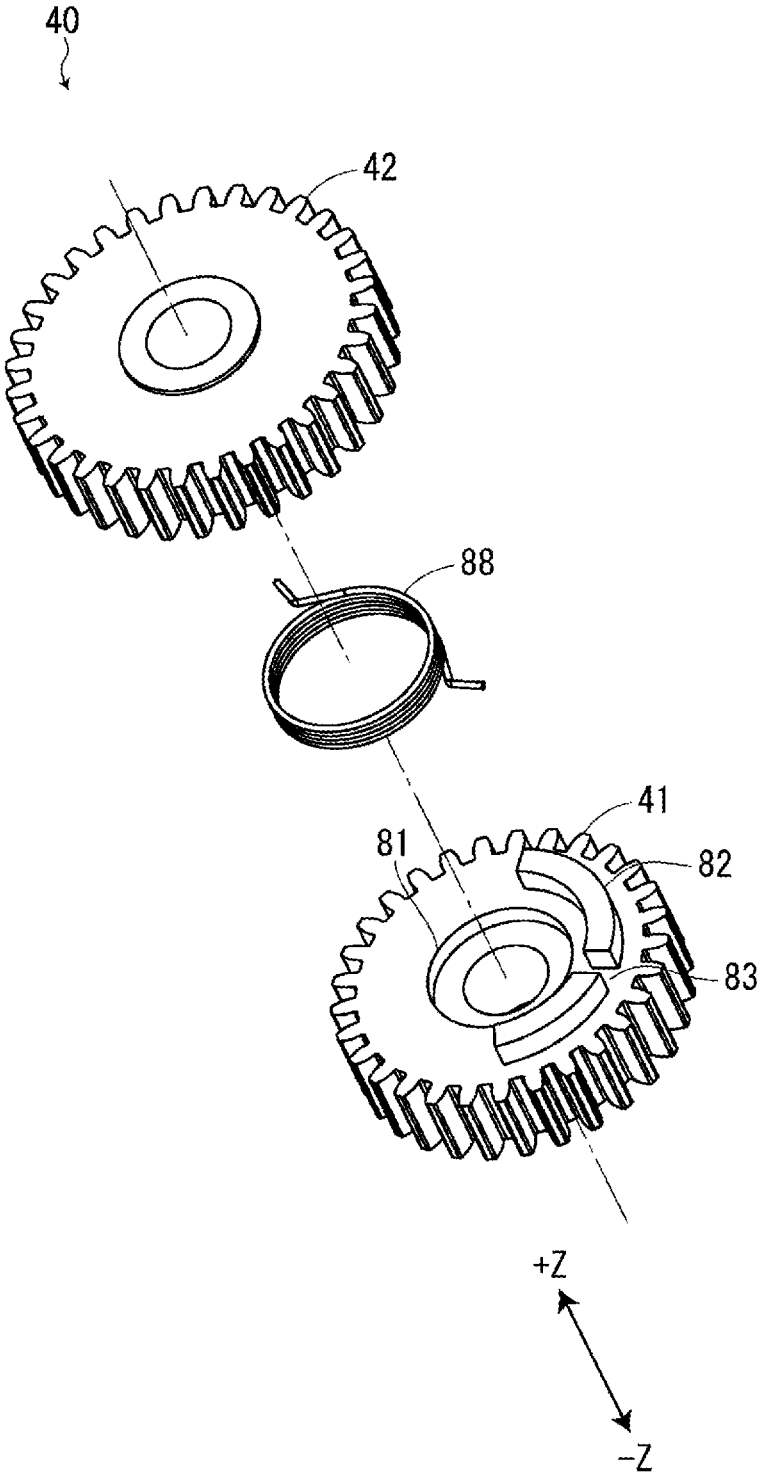
FIG. 11 is an exploded, perspective view of the twin gear.

Referring to FIG. 11, the twin gear 40 includes: the input gear 41; an intermediate gear 42 disposed in back of the input gear 41 in the attachment direction; and a clearance reserving gear 88 disposed between the input gear 41 and the intermediate gear 42. Further, the input gear 41 is coaxial with the intermediate gear 42.

The input gear 41 is provided with an input-gear-side engaging recess 81 and an input-gear-side engaging section 82 on one of its surfaces which is closer to the intermediate gear 42, namely, on the front surface as viewed from the attachment direction. The input-gear-side engaging recess 81 is concentric with the input gear 41 and has a substantially circular shape. The input-gear-side engaging section 82 is disposed around the input-gear-side engaging recess 81 while protruding in the direction opposite to the attachment direction. Further, the input-gear-side engaging section 82 is concentric with the input gear 41 and has a substantially arc shape. Disposed in substantially the longitudinal center of the input-gear-side engaging section 82 is an input-gear-side spring retainer 83.

Figure 12:
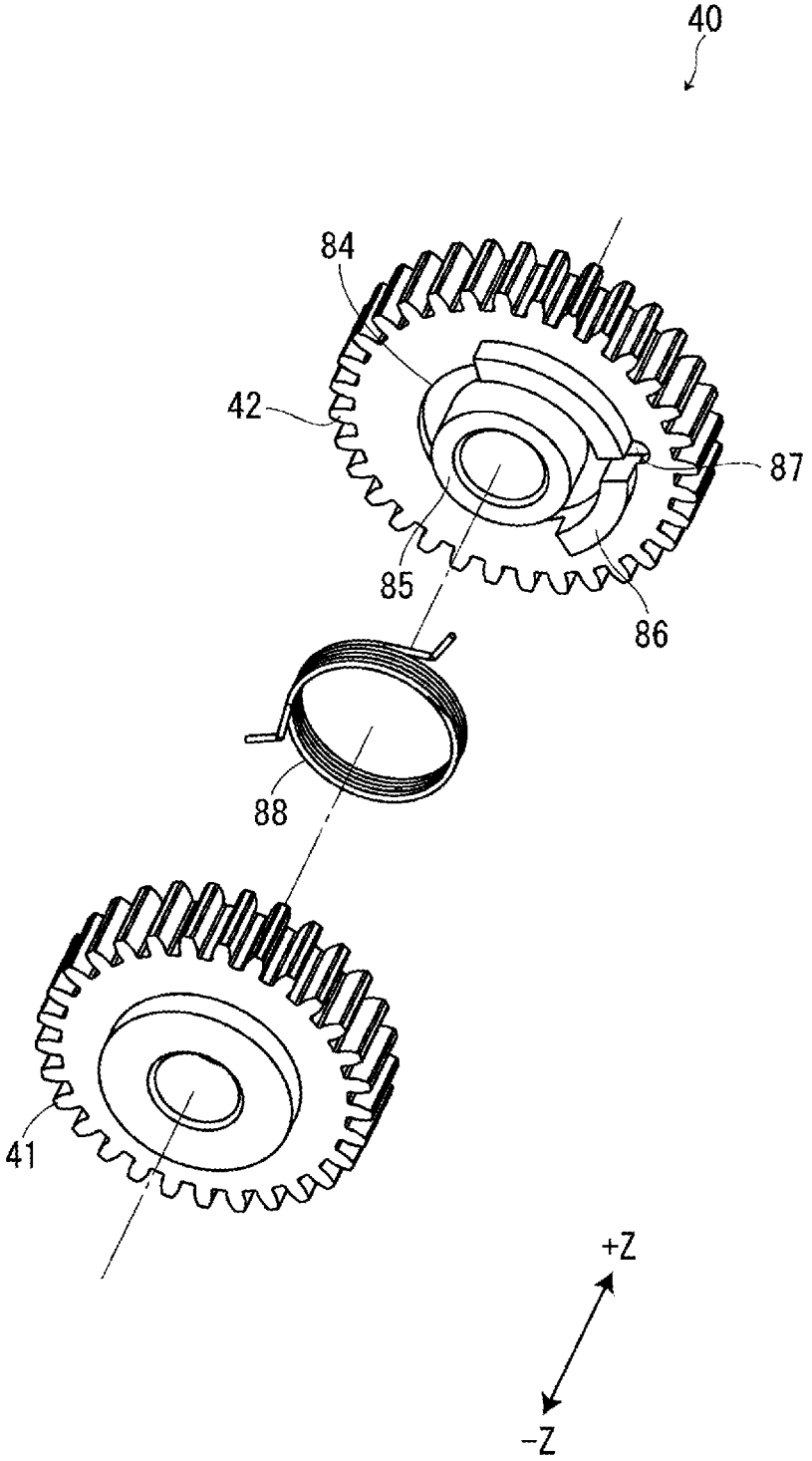
FIG. 12 is another exploded perspective view of the twin gear, as viewed from a direction different from that of FIG. 11.

Referring to FIG. 12, the intermediate gear 42 is provided with a spring mount recess 84, an intermediate-gear-side mating projection 85, and an intermediate-gear-side engaging section 86 on one of the surfaces which is closer to the input gear 41, namely, on the rear surface as viewed from the attachment direction. Further, the spring mount recess 84 is concentric with the intermediate gear 42 and has a substantially circular shape. The intermediate-gear-side mating projection 85 protrudes in the attachment direction from the bottom surface of the spring mount recess 84. Further, the intermediate-gear-side mating projection 85 is concentric with the intermediate gear 42 and has a substantially circular shape. The intermediate-gear-side mating projection 85 is fitted into the input-gear-side engaging recess 81. The intermediate-gear-side engaging section 86 is disposed around the intermediate-gear-side mating projection 85 while protruding in the attachment direction. The intermediate-gear-side engaging section 86 is concentric with the intermediate gear 42 and has a substantially arc shape. Disposed in substantially the longitudinal center of the intermediate-gear-side engaging section 86 is an intermediate-gear-side spring retainer 87.

Figure 13:
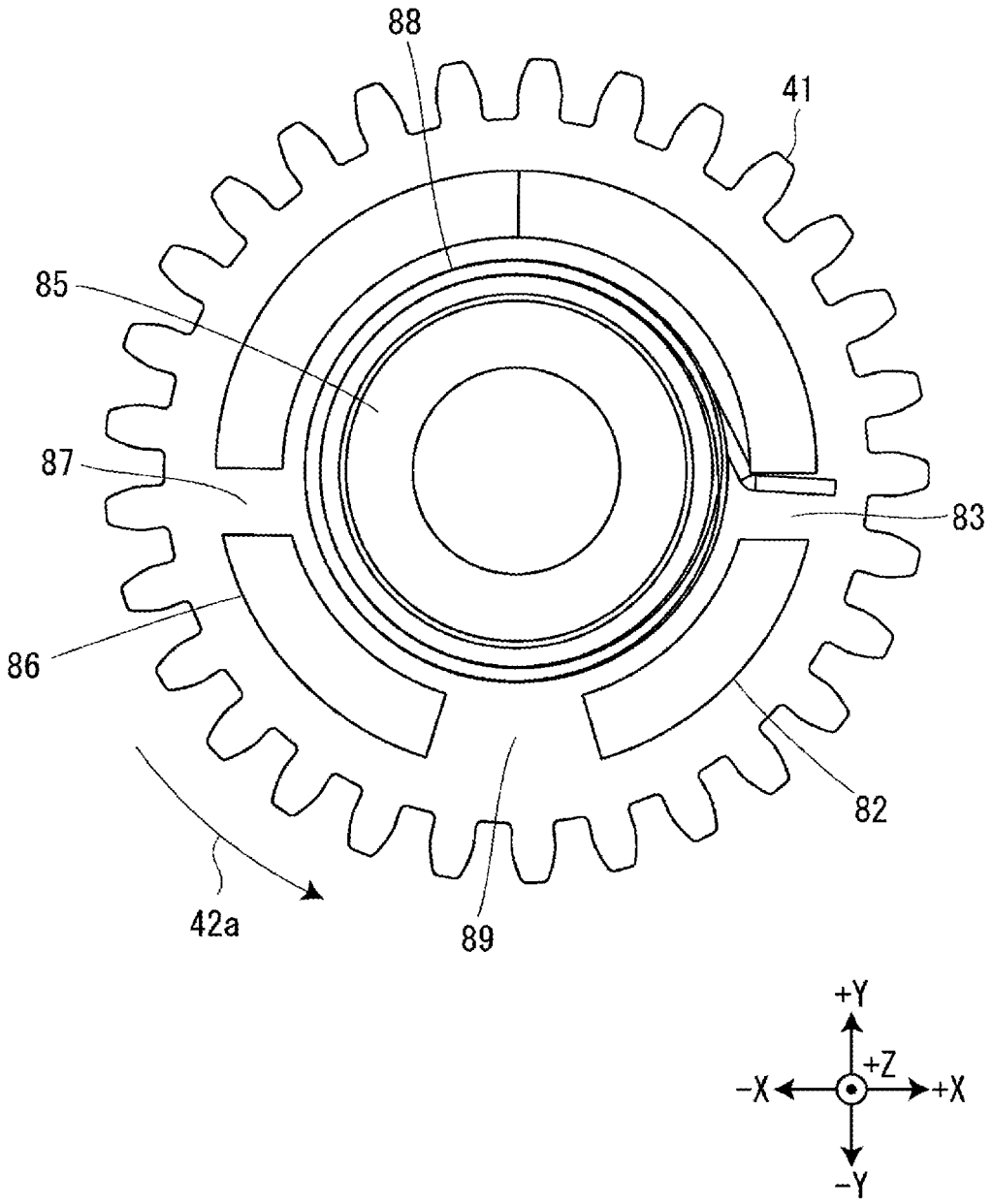
FIG. 13 illustrates a clearance between the input-gear-side engaging section and the intermediate-gear-side engaging section.

The clearance reserving gear 88 is disposed in the spring mount recess 84 and around the intermediate-gear-side mating projection 85. In one embodiment, the clearance reserving gear 88 may be a torsion coil spring. A first end of the clearance reserving gear 88 is placed in the input-gear-side spring retainer 83 of the input gear 41, whereas a second end of the clearance reserving gear 88 is placed in the intermediate-gear-side spring retainer 87 of the intermediate gear 42. When being placed in the input gear 41, the clearance reserving gear 88 applies force to the intermediate gear 42 in the second intermediate direction 42*b*. Referring to FIG. 13, a clearance 89 is reserved between the input-gear-side engaging section 82 and the intermediate-gear-side engaging section 86 and next to the front end of the input-gear-side engaging section 82 in the first intermediate direction 42*a*. Herein, the clearance reserving gear 88 corresponds to an example of an "elastic member".

First Winding Core and First Paying Out Core

Figure 14:
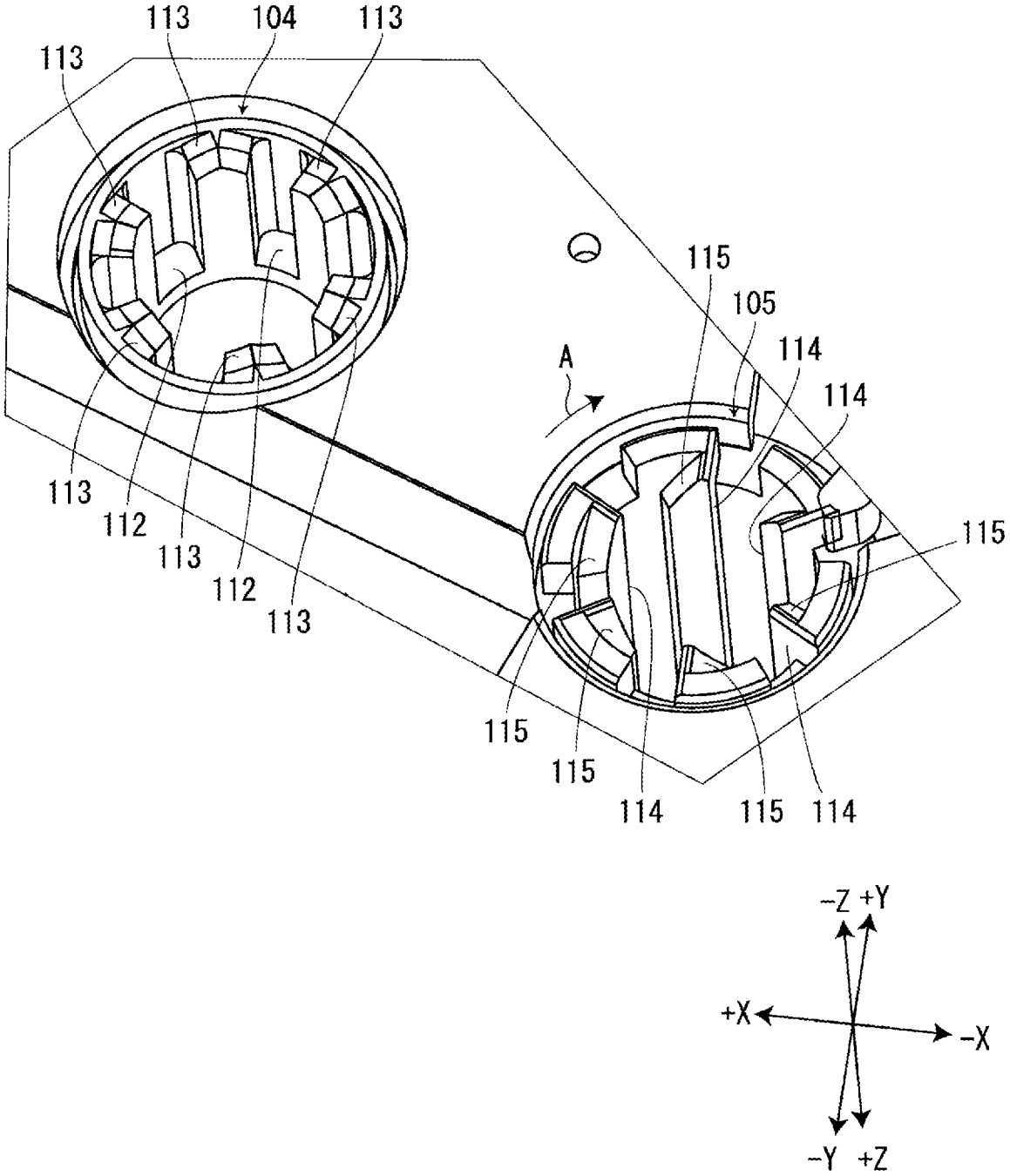
FIG. 14 is an enlarged view of the first paying out core and the second winding core in the tape cartridge.

Referring to FIG. 14, the rear surface of the first paying out core 104 in the tape cartridge 101 as viewed from the attachment direction is provided with six first-paying-out-core-side engaging recesses 112 and six first-paying-out-core-side ends 113, which are alternately arranged along the inner circumference of the first paying out core 104. When the tape cartridge 101 is attached to the cartridge mount section 2 of the tape printing apparatus 1, the three first-paying-out-rotor-side engaging projections 31 (see FIG. 3) of the first paying out rotor 15 engage with corresponding ones of the six first-paying-out-core-side engaging recesses 112. The first paying out core 104 thereby can rotate together with the first paying out rotor 15. Each of the first-paying-out-core-side ends 113 is chamfered on both side surfaces. The configuration, described above, of the first paying out core 104 is similar to that of the second paying out core 204.

The first winding core 105 is provided with six first-winding-core-side engaging projections 114 that protrude from the inner circumferential surface. The first-winding-core-side engaging projections 114 are arranged at substantially equal intervals on the inner circumferential surface of the first winding core 105 while extending in the axial direction of the first winding core 105, namely, in the attachment direction. When the tape cartridge 101 is attached to the cartridge mount section 2 of the tape printing apparatus 1, the three first-winding-rotor-side engaging projections 32 (see FIG. 3) of the first winding rotor 16 enter into the first winding core 105 and engage the corresponding ones of the first-winding-core-side engaging projections 114. The first winding core 105 thereby can rotate together with the first winding rotor 16. Each of the ends of the first-winding-core-side engaging projections 114 in the attachment direction is provided with a first-winding-core-side engagement slope 115. The configuration, described above, of the first winding core 105 is similar to that of the second winding core 205.

Attaching of Tape Cartridge

When the tape cartridge 101 is attached to the cartridge mount section 2 of the tape printing apparatus 1 configured above, the ends, in the attachment direction, of the first-winding-core-side engaging projections 114 in the tape cartridge 101 abut against the first-winding-rotor-side engaging ends 32*a* (see FIG. 6) of the first-winding-rotor-side engaging projections 32 in the tape printing apparatus 1. Then, owing to the first-winding-core-side engagement slopes 115 provided at the ends of the first-winding-core-side engaging projections 114, the first winding core 105 rotates in the winding direction denoted by the arrow A in FIG. 14. As a result, the first-winding-rotor-side engaging projections 32 are permitted to enter into the first winding core 105. This configuration helps smooth attaching of the tape cartridge 101 to the cartridge mount section 2. In addition, the first winding core 105 suppresses the first ink ribbon 109 from becoming loose by rotating in the winding direction.

Following the above, the first paying out rotor 15 of the tape printing apparatus 1 is inserted into the first paying out core 104 of the tape cartridge 101. In which case, the first paying out rotor 15 rotates, but the first paying out core 104 does not rotate. This configuration helps smooth attaching of the tape cartridge 101 to the cartridge mount section 2. The reason is as follows: if the first paying out core 104 rotates in the rewinding direction, the portion of the first ink ribbon 109 on which the information has been printed may be fed back, or if the first paying out core 104 rotates in the paying out direction, the first ink ribbon 109 may become loose.

Figure 15:
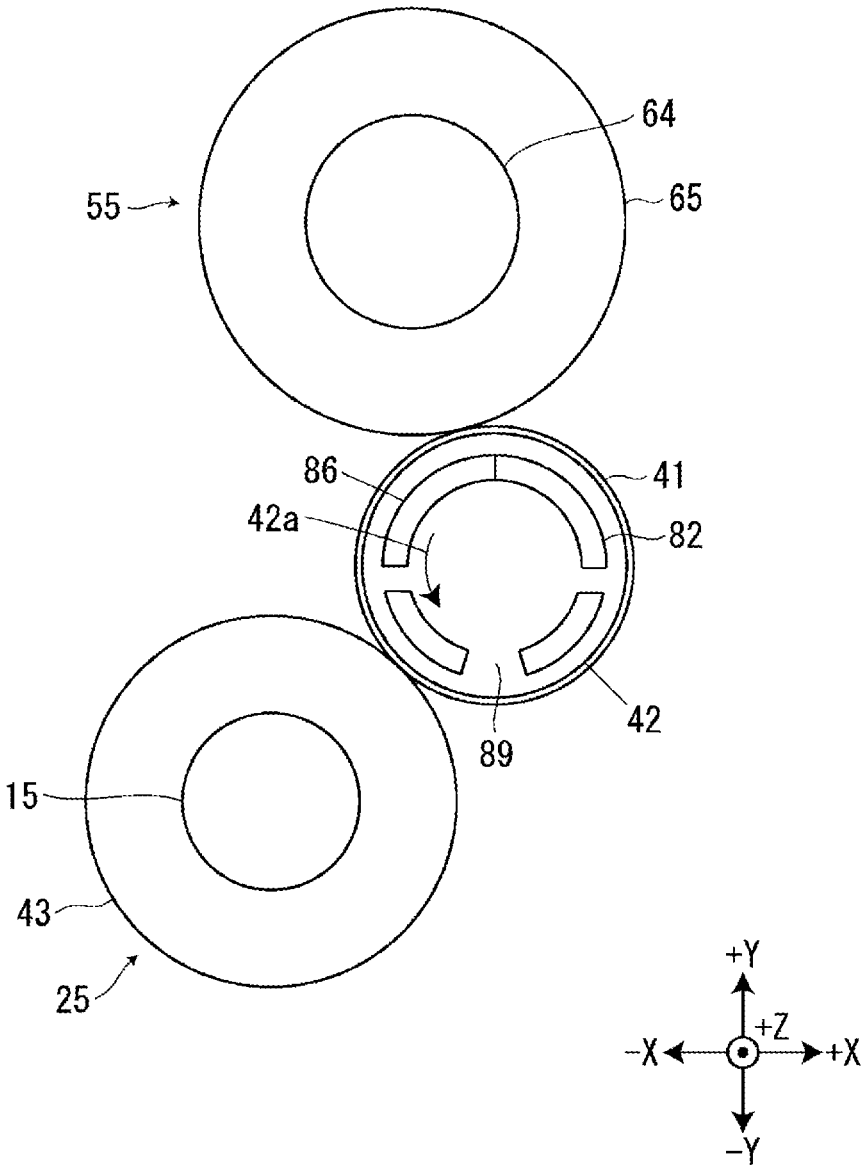
FIG. 15 illustrates a rotational state of the paying-out-side gear train before the tape cartridge is attached to the cartridge mount section of the tape printing apparatus.
Figure 16:
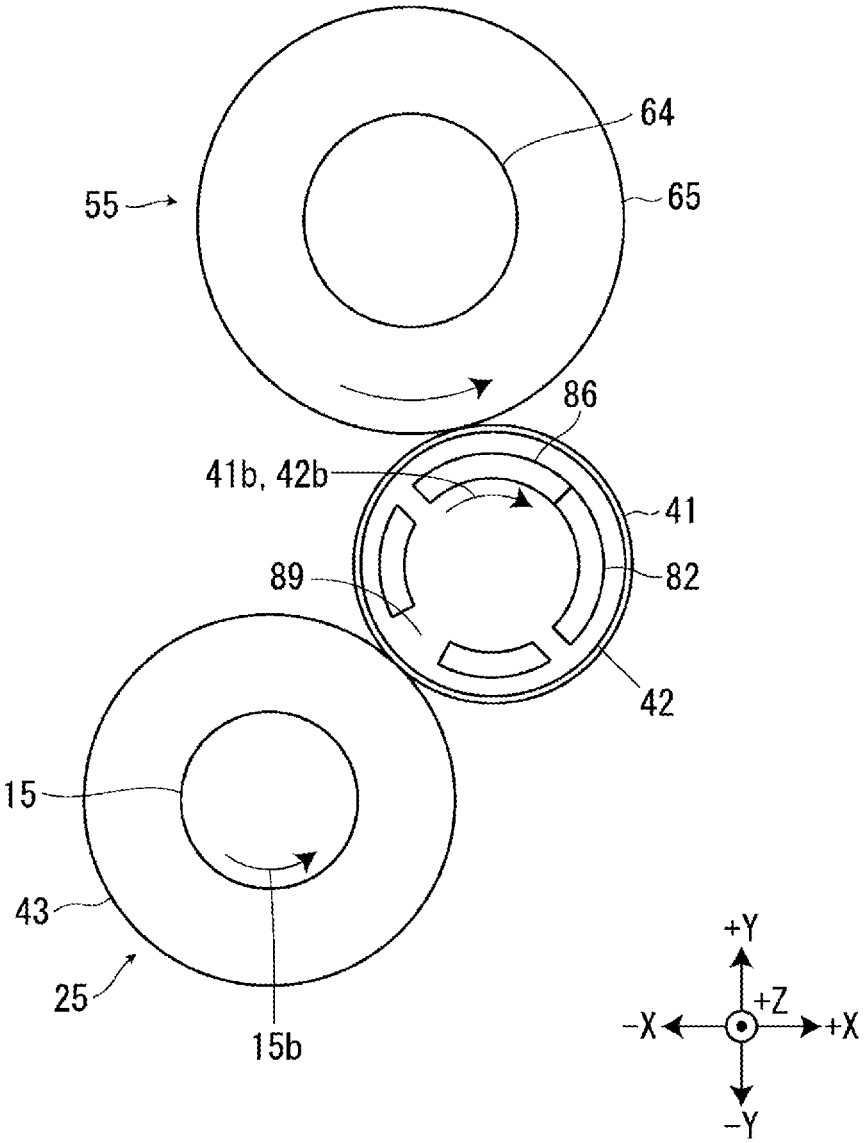
FIG. 16 illustrates the rotation of the first paying out rotor in a second paying out direction which has been in the state of FIG. 15.

When the tape cartridge 101 is attached to the cartridge mount section 2, the first-paying-out-core-side ends 113 of the first paying out core 104 abut against the first rear engagement slopes 31*b* (see FIG. 5) of the first-paying-out-rotor-side engaging projections 31 of the first paying out shaft 9. Then, the first paying out rotor 15 that has been in the state of FIG. 15 rotates in the second paying out direction 15*b*, as illustrated in FIG. 16. In which case, the paying-out-side outer ring member 65 rotates, but the paying-out-side inner ring member 64 does not rotate. In other words, the paying-out-side outer ring member 65 rotates at idle because the paying-out-side outer ring member 65 does not engage with the paying-out-side inner ring member 64. Hence, the input gear 41 is permitted to rotate in the second input direction 41*b*, and the intermediate gear 42 is permitted to rotate in the second intermediate direction 42*b*. In response, the first paying out rotor 15 rotates in the second paying out direction 15*b*. As a result, the first-paying-out-rotor-side engaging projections 31 of the first paying out shaft 9 enter into the first-paying-out-core-side engaging recess 112. This configuration helps smooth attaching of the tape cartridge 101 to the cartridge mount section 2. It should be noted that the intermediate gear 42 is shorter in diameter than the input gear 41 in FIGS. 15 to 22, but their actual diameters are identical to each other.

Figure 17:
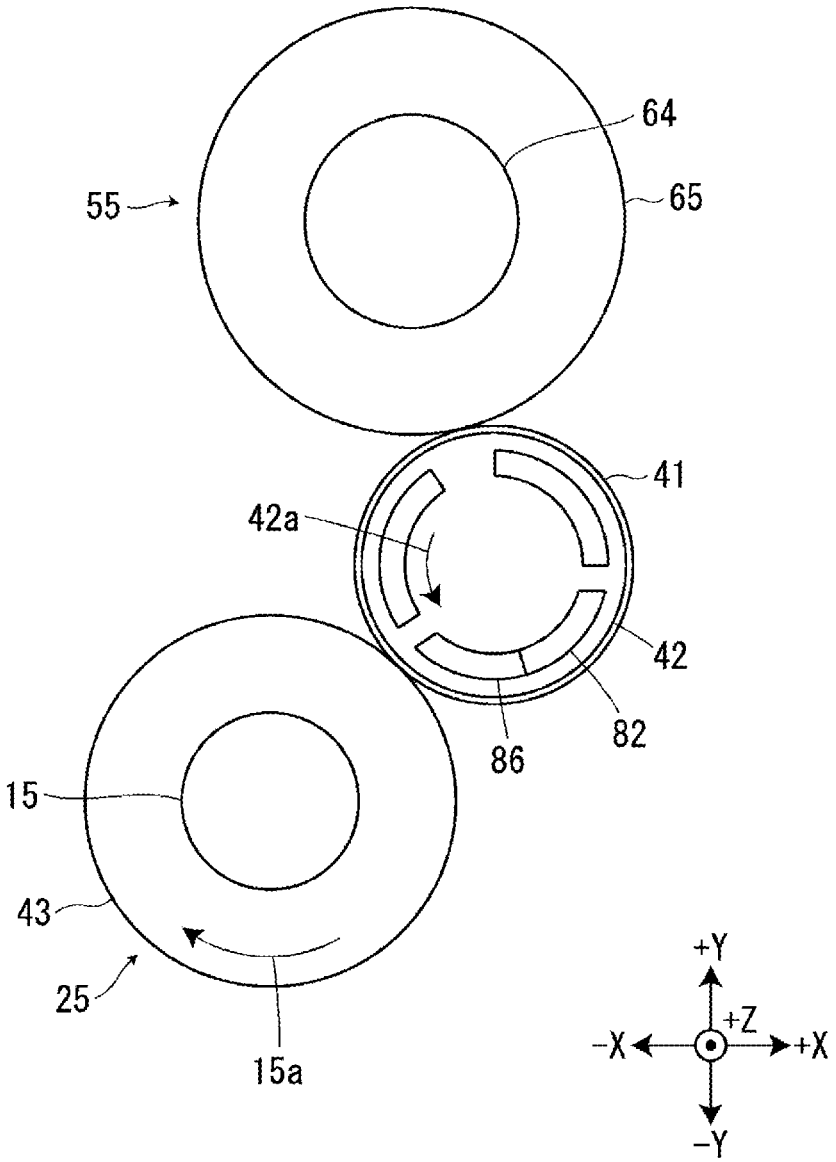
FIG. 17 illustrates the rotation of the first paying out rotor in a first paying out direction which has been in the state of FIG. 15.

When the tape cartridge 101 is attached to the cartridge mount section 2, the first-paying-out-core-side ends 113 of the first paying out core 104 abut against the first front engagement slopes 31*a* (see FIG. 5) of the first-paying-out-rotor-side engaging projections 31 of the first paying out shaft 9. Then, the first paying out rotor 15 that has been in the state of FIG. 15 rotates in the first paying out direction 15*a*, as illustrated in FIG. 17. In this case, both the paying-out-side inner ring member 64 and the paying-out-side outer ring member 65 rotate together, because the paying-out-side outer ring member 65 engages with the paying-out-side inner ring member 64. Hence, the input gear 41 is suppressed from rotating in the first input direction 41*a*, and the intermediate gear 42 is suppressed from rotating in the first intermediate direction 42*a*. As illustrated in FIG. 15, the clearance 89 is reserved, by the clearance reserving gear 88, between the input-gear-side engaging section 82 and the intermediate-gear-side engaging section 86 and next to the front end of intermediate-gear-side engaging section 86 in the first intermediate direction 42*a*. Thus, the intermediate gear 42 rotates in the first intermediate direction 42*a*, as illustrated in FIG. 17, until the clearance 89 is eliminated, in other words, until the end of the intermediate-gear-side engaging section 86 in the first intermediate direction 42*a* makes contact with the end of the input-gear-side engaging section 82 in the direction opposite to the first intermediate direction 42*a*. In accordance with this rotation, the first paying out rotor 15 also rotates in the first paying out direction 15*a*. As a result, the first-paying-out-rotor-side engaging projection 31 enters into the first-paying-out-core-side engaging recess 112. This configuration helps smooth attaching of the tape cartridge 101 to the cartridge mount section 2.

The above mechanism is also applicable to the attaching of the ribbon cartridge 201 to the tape printing apparatus 1. More specifically, when the ribbon cartridge 201 is attached to the cartridge mount section 2, the second winding core 205 rotates in the winding direction. This configuration helps smooth attaching of the ribbon cartridge 201 to the cartridge mount section 2. Moreover, when the ribbon cartridge 201 is attached to the cartridge mount section 2, the second paying out rotor 17 is rotatable in both the first and second directions. This configuration also helps smooth attaching of the ribbon cartridge 201 to the cartridge mount section 2.

Modifications

The foregoing embodiment may be modified in various ways without departing from the scope of the present disclosure. Some conceivable modifications will be described below.

Figure 18:
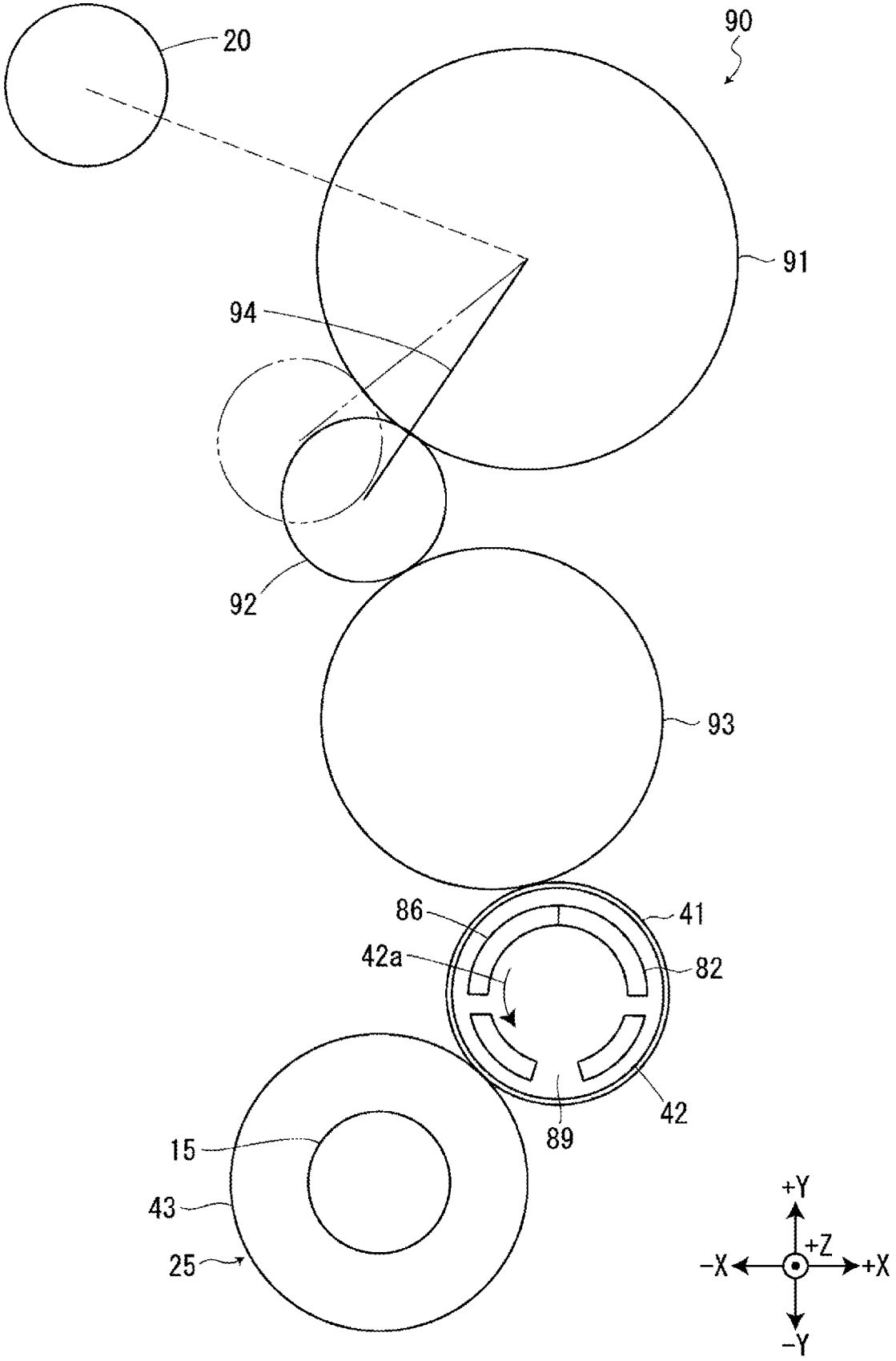
FIG. 18 illustrates a clutch mechanism in a tape printing apparatus according to a modification.

As illustrated in FIG. 18, the tape printing apparatus 1 may include a clutch mechanism 90 instead of the paying-out-side one-way clutch 55. The clutch mechanism 90 includes a first clutch gear 91, a second clutch gear 92, a third clutch gear 93, and a gear support member 94. The first clutch gear 91 receives the rotational power from the transport motor 20. The second clutch gear 92 continuously engages with the first clutch gear 91 while moving around the first clutch gear 91 and temporarily engages with or is disengaged from the third clutch gear 93. The third clutch gear 93 engages with the input gear 41. The gear support member 94 is rotatably disposed on the support shaft of the first clutch gear 91 and rotatably supports the second clutch gear 92.

Figure 19:
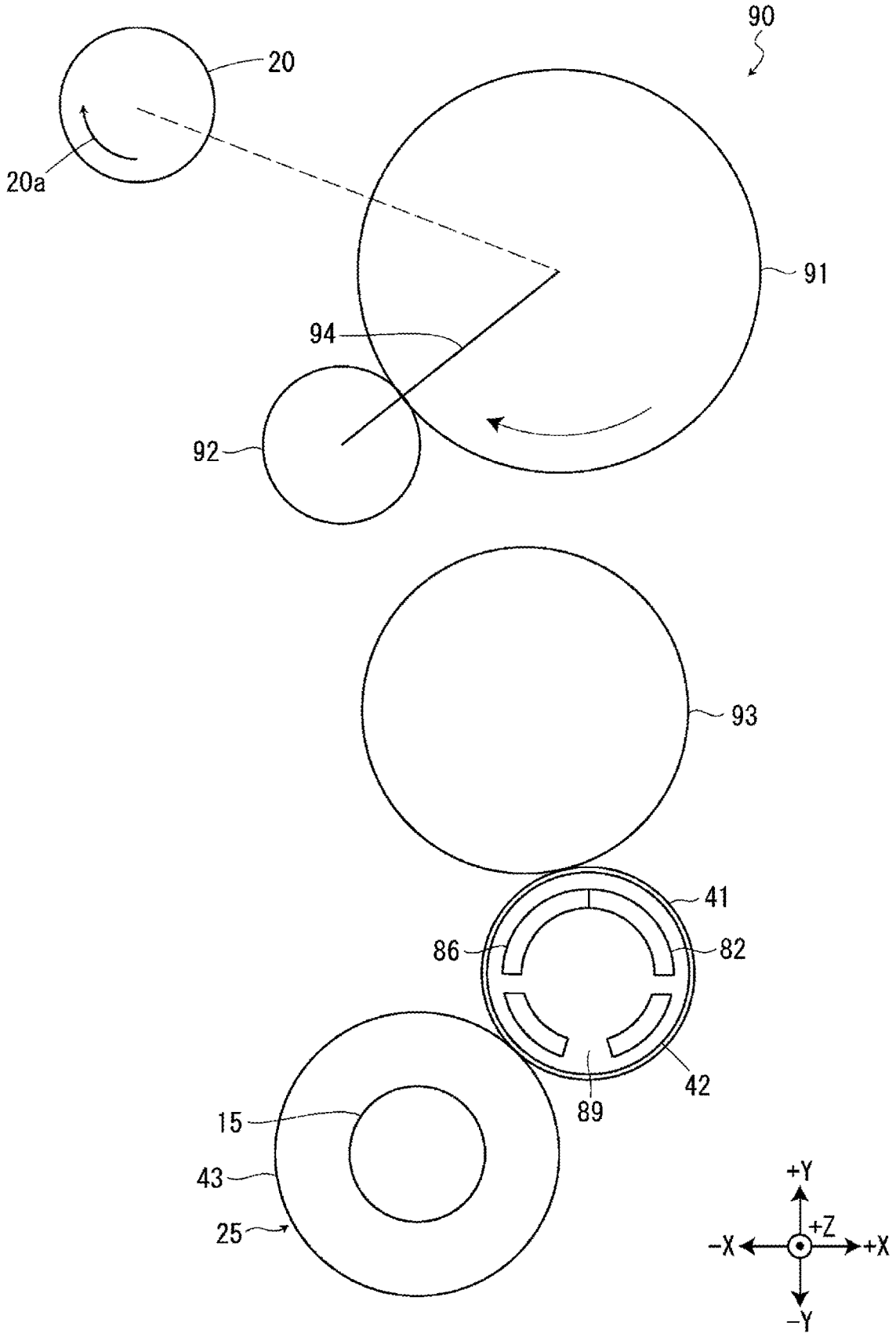
FIG. 19 illustrates a state of the clutch mechanism when the transport motor rotates in a first motor direction.
Figure 20:
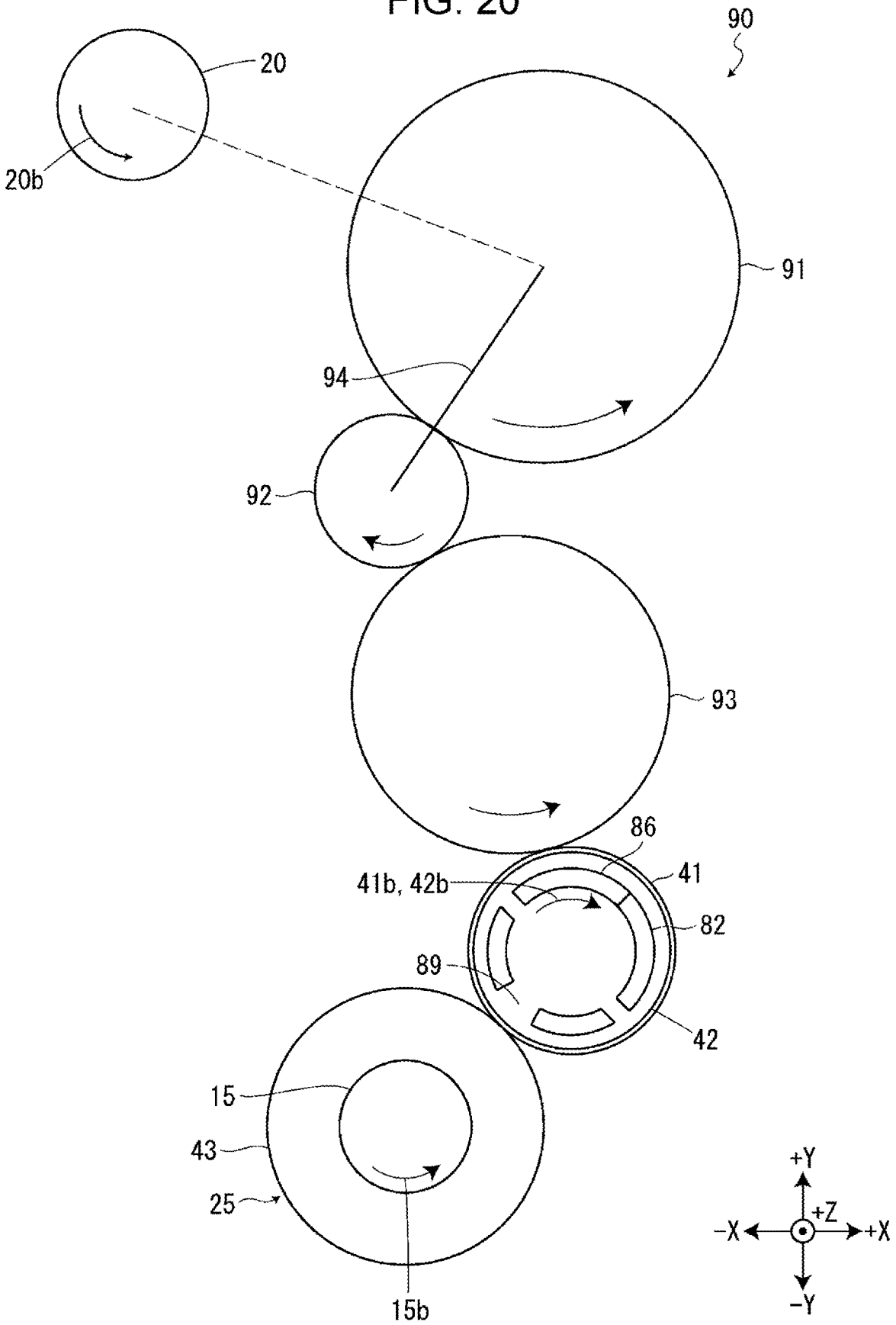
FIG. 20 illustrates a state of the clutch mechanism when the transport motor rotates in a second motor direction.

When the transport motor 20 rotates in the first motor direction 20*a*, the rotational power is transmitted from the transport motor 20 to the first clutch gear 91 in the clutch mechanism 90, as illustrated in FIG. 19. Then, the first clutch gear 91 rotates in the first direction. In response, the gear support member 94 rotates together with the first clutch gear 91, and the second clutch gear 92 is thereby disengaged from the third clutch gear 93. As a result, the rotational power is not transmitted from the transport motor 20 to the first paying out rotor 15. When the transport motor 20 rotates in the second motor direction 20*b*, the rotational power is transmitted from the transport motor 20 to the first clutch gear 91 in the clutch mechanism 90, as illustrated in FIG. 20. Then, the first clutch gear 91 rotates in the second direction. In response, the gear support member 94 rotates together with the first clutch gear 91, and the second clutch gear 92 thereby engages with the third clutch gear 93. As a result, the rotational power is transmitted from the transport motor 20 to the first paying out rotor 15.

Figure 21:
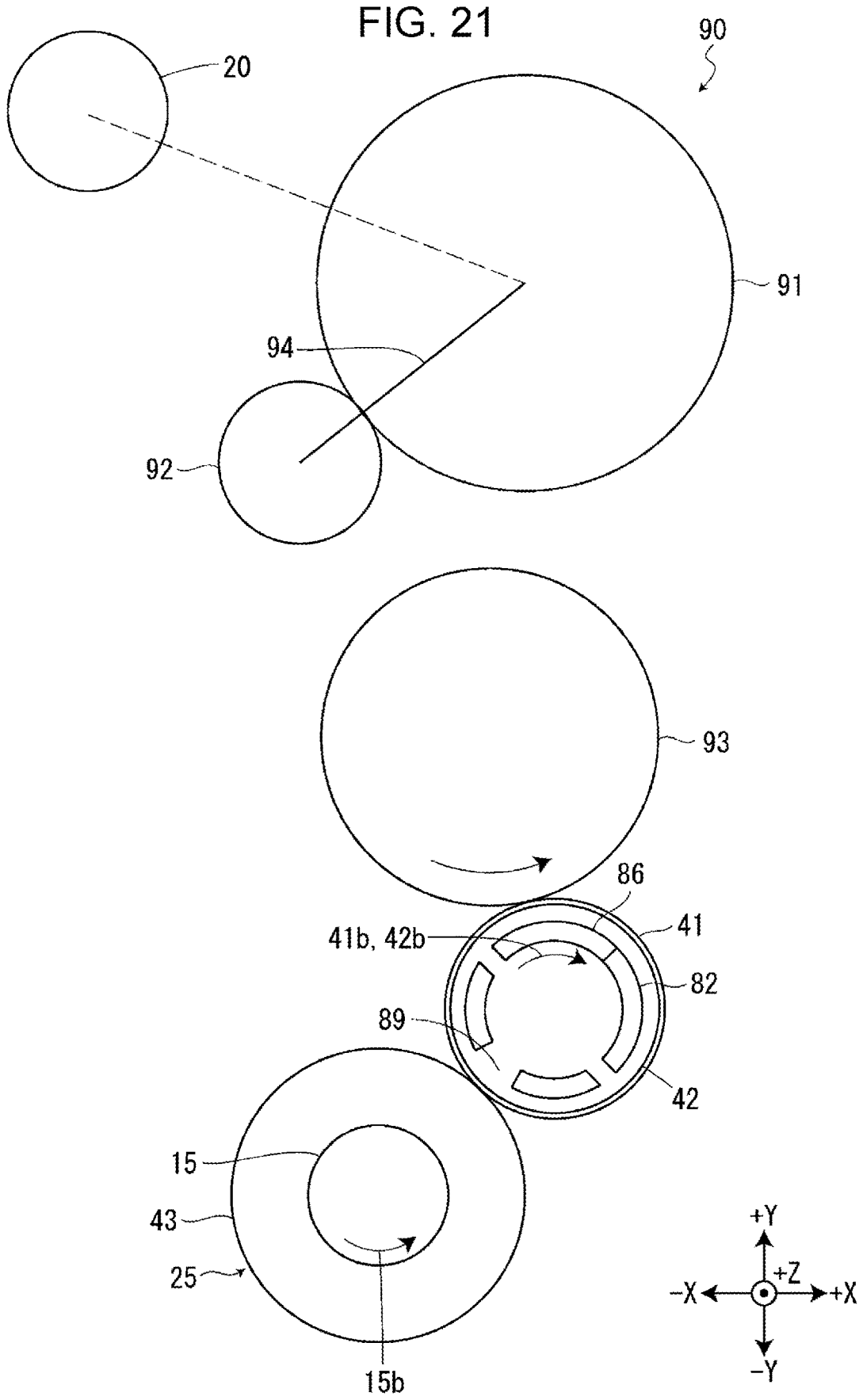
FIG. 21 illustrates the first paying out rotor that transits from the state of FIG. 18 to the state of rotating in the second paying out direction.

As described above, when the tape cartridge 101 is attached to the cartridge mount section 2 of the tape printing apparatus 1, if the first-paying-out-core-side ends 113 of the first paying out core 104 abut against the corresponding first rear engagement slopes 31*b* of the first-paying-out-rotor-side engaging projections 31, the first paying out rotor 15 that has been in the state of FIG. 18 attempts to rotate in the second paying out direction 15*b*, as illustrated in FIG. 21. In this case, since the second clutch gear 92 is disengaged from the third clutch gear 93, the input gear 41 is permitted to rotate in the second input direction 41*b*, and the intermediate gear 42 is permitted to rotate in the second intermediate direction 42*b*. As a result, the first paying out rotor 15 rotates in the second paying out direction 15*b*, thereby allowing the first-paying-out-rotor-side engaging projections 31 of the first paying out shaft 9 to enter into the first-paying-out-core-side engaging recess 112. This configuration helps smooth attaching of the tape cartridge 101 to the cartridge mount section 2.

Figure 22:
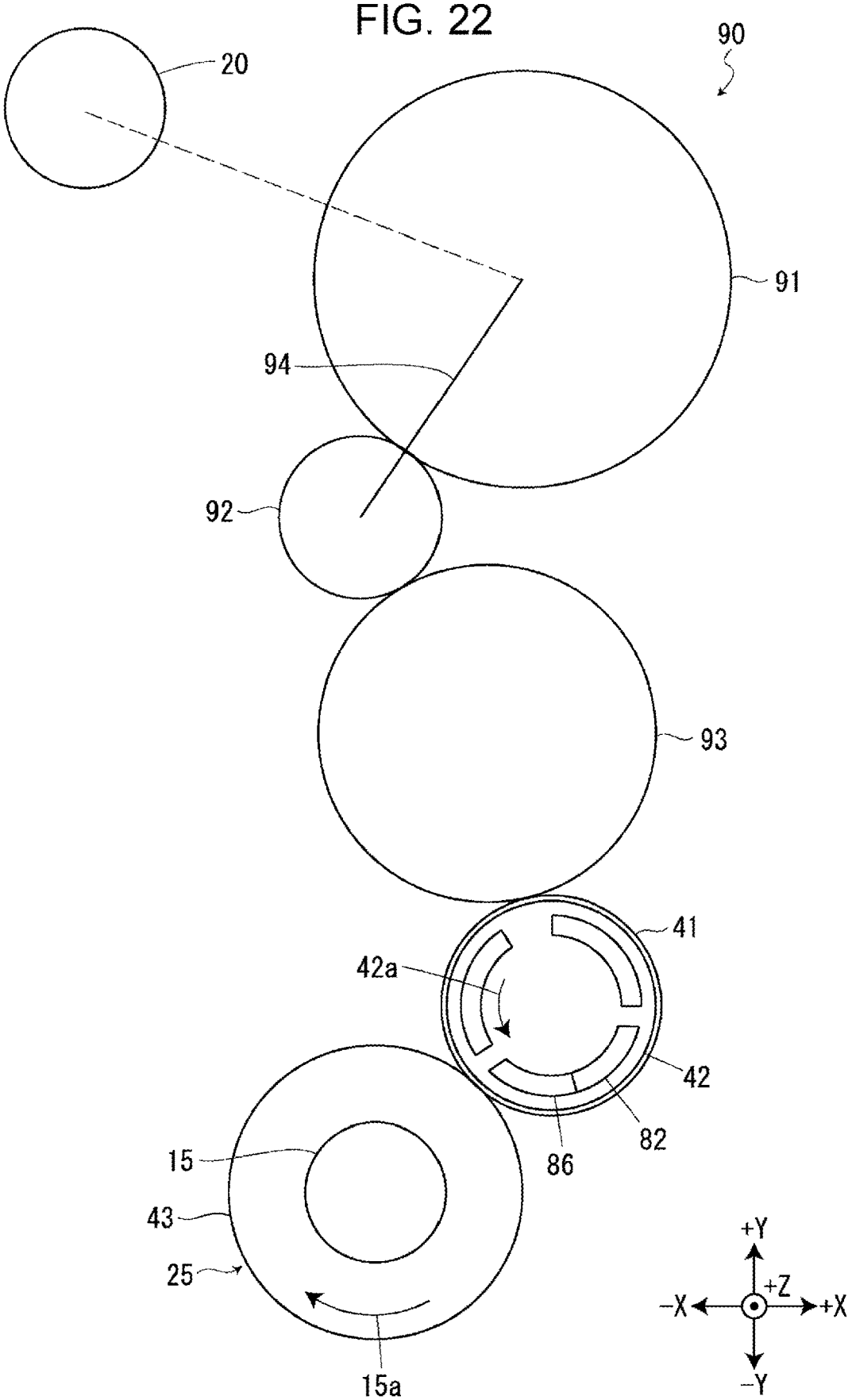
FIG. 22 illustrates the first paying out rotor that transits from the state of FIG. 18 to the state of rotating in the first paying out direction.

When the tape cartridge 101 is attached to the cartridge mount section 2 of the tape printing apparatus 1, if the first-paying-out-core-side ends 113 of the first paying out core 104 abut against the corresponding first front engagement slopes 31*a* of the first-paying-out-rotor-side engaging projections 31 in the cartridge mount section 2, the first paying out rotor 15 that has been in the state of FIG. 18 attempts to rotate in the first paying out direction 15*a*, as illustrated in FIG. 22. In this case, since the second clutch gear 92 keeps engaging with the third clutch gear 93, the input gear 41 is suppressed from rotating in the first input direction 41*a*, and the intermediate gear 42 is suppressed from rotating in the first intermediate direction 42*a*. As illustrated in FIG. 18, the clearance 89 is reserved, by the clearance reserving gear 88, between the input-gear-side engaging section 82 and the intermediate-gear-side engaging section 86 and next to the front end of intermediate-gear-side engaging section 86 in the first intermediate direction 42*a*. Thus, the intermediate gear 42 rotates in the first intermediate direction 42*a*, as illustrated in FIG. 22, until the clearance 89 between the input-gear-side engaging section 82 and the intermediate-gear-side engaging section 86 is eliminated. In accordance with the rotation of the intermediate gear 42, the first paying out rotor 15 rotates in the first paying out direction 15*a*, thereby allowing the first-paying-out-rotor-side engaging projections 31 of the first paying out shaft 9 to enter into the first-paying-out-core-side engaging recess 112. This configuration helps smooth attaching of the tape cartridge 101 to the cartridge mount section 2.

Figure 23:
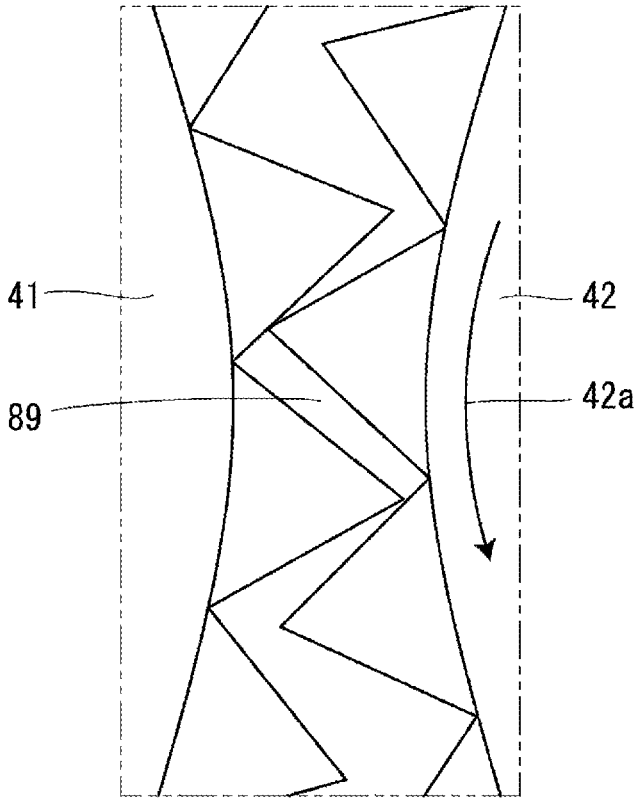
FIG. 23 illustrates an input gear and an intermediate gear in a tape printing apparatus according to another modification.

In the twin gear 40, the input gear 41 does not necessarily have to be coaxial with the intermediate gear 42. Alternatively, the input gear 41 may engage with the intermediate gear 42, for example. In this case, as illustrated in FIG. 23, an elastic member may be provided in addition to an input gear 41 and an intermediate gear 42 that engage with each other. This elastic member may apply force to the intermediate gear 42 in a second intermediate direction 42*b* so as to reserve a backlash, or a clearance 89, between the input gear 41 and the intermediate gear 42 and next to the front end of the intermediate gear 42 in the first intermediate direction 42*a*.

The cartridge mount section 2 of the tape printing apparatus 1 is not necessarily configured to selectively accommodate the tape cartridge 101 and the ribbon cartridge 201. As an alternative example, the cartridge mount section 2 may be configured to accommodate only the tape cartridge 101, in which case the second paying out rotor 17 and the second winding rotor 18 are unnecessary. As another alternative example, the cartridge mount section 2 may be configured to accommodate only the ribbon cartridge 201, in which case the first paying out rotor 15 and the first winding rotor 16 are unnecessary. Moreover, the present disclosure may be applied to ribbon transport mechanisms without the printing head 6.

The configurations in the foregoing embodiment and modifications may be combined together.

Supplementary Notes

A description will be given below of supplementary notes of a ribbon transport mechanism and a tape printing apparatus according to some aspects of the present disclosure.

A ribbon transport mechanism provided in a tape printing apparatus includes a paying out rotor and a winding rotor. When a cartridge that includes a paying out core around which an ink ribbon is wound and a winding core that winds the ink ribbon paid out from the paying out core is attached to a cartridge mount section of the tape printing apparatus, the paying out rotor engages with the paying out core and the winding rotor engages with the winding core. The ribbon transport mechanism further includes a transport motor that generates rotational power and a transport gear train that transmits the rotational power from the transport motor to the paying out rotor. The transport gear train includes an input gear, an intermediate gear, a clutch mechanism, and an elastic member. The input gear receives the rotational power from the transport motor. The intermediate gear, which engages with the input gear, receives the rotational power from the transport motor via the input gear and transmits the received rotational power to the paying out rotor. When the cartridge is attached, the clutch mechanism suppresses the input gear from rotating in a first input direction and the intermediate gear from rotating in a first intermediate direction and permits the input gear to rotate in a second input direction and the intermediate gear to rotate in a second intermediate direction; the second input direction is opposite to the first input direction, and the second intermediate direction is opposite to the first intermediate direction. The elastic member applies force to the intermediate gear in the second intermediate direction to reserve a clearance between the input gear and the intermediate gear and next to a front end of the intermediate gear in the first intermediate direction.

The above configuration, when the cartridge is attached, permits the input gear to rotate in the second input direction and the intermediate gear to rotate in the second intermediate direction. As a result, the paying out rotor is rotatable in a second paying out direction, which is related to both the second input direction and the second intermediate direction. In addition, since the clearance is reserved between the input gear and the intermediate gear and next to the front end of the intermediate gear in the first intermediate direction, the intermediate gear is rotatable in the first intermediate direction until the clearance is removed. As a result, the paying out rotor is rotatable in a first paying out direction, which is related to the first intermediate direction. Therefore, the cartridge can be attached smoothly to the cartridge mount section even if the paying out core abuts against the paying out rotor in the course of the attaching.

In the above ribbon transport mechanism, the input gear may be coaxial with the intermediate gear. One of the surfaces of the input gear which is closer to the intermediate gear may be provided with an input-gear-side engaging section. One of the surfaces of the intermediate gear which is closer to the input gear may be provided with an intermediate-gear-side engaging section; the intermediate-gear-side engaging section may engage with the input-gear-side engaging section. Both the input-gear-side engaging section and the intermediate-gear-side engaging section may reserve a clearance in-between.

The above configuration can reserve a large clearance in a simple manner, compared to the configuration in which an input gear engages with an intermediate gear. Therefore, the paying out core is rotatable largely when the cartridge is attached to the cartridge mount section.

In the above ribbon transport mechanism, the clutch mechanism may include an inner gear member and an outer gear member; the outer gear member may be disposed on an outer circumference of the inner gear member. When the cartridge is attached, in a case in which the input gear attempts to rotate in the first input direction and the intermediate gear attempts to rotate in the first intermediate direction, the clutch mechanism may cause the inner gear member to engage with the outer gear member to suppress the input gear from rotating in the first input direction and the intermediate gear from rotating in the first intermediate direction. When the cartridge is attached, in a case in which the input gear attempts to rotate in the second input direction and the intermediate gear attempts to rotate in the second intermediate direction, the clutch mechanism may disengage the inner gear member from the outer gear member to permit the input gear to rotate in the second input direction and the intermediate gear to rotate in the second intermediate direction.

The above configuration can achieve a clutch mechanism in a simple manner.

In the above ribbon transport mechanism, the clutch mechanism may include a first clutch gear that receives the rotational power from the transport motor, a second clutch gear that engages with the first clutch gear, and a third clutch gear that engages with or is disengaged from the second clutch gear. When the cartridge is attached, in a case in which the input gear attempts to rotate in the first input direction and the intermediate gear attempts to rotate in the first intermediate direction, the clutch mechanism may cause the second clutch gear to engage with the third clutch gear to suppress the input gear from rotating in the first input direction and the intermediate gear from rotating in the first intermediate direction. When the cartridge is attached, in a case in which the input gear attempts to rotate in the second input direction and the intermediate gear attempts to rotate in the second intermediate direction, the clutch mechanism may disengage the second clutch gear from the third clutch gear to permit the input gear to rotate in the second input direction and the intermediate gear to rotate in the second intermediate direction.

The above configuration can achieve a clutch mechanism in a simple manner.

A tape printing apparatus to which a cartridge that includes a paying out core around which an ink ribbon is wound and a winding core that winds the ink ribbon paid out from the paying out core is to be attached includes a cartridge mount section to which the cartridge is to be attached. A paying out rotor, when the cartridge is attached to the cartridge mount section, engages with the paying out core. A winding rotor, when the cartridge is attached to the cartridge mount section, engages with the winding core. A transport motor generates rotational power. A transport gear train transmits the rotational power from the transport motor to the paying out rotor. A printing head performs a printing operation on a print tape. A transport gear train includes an input gear, an intermediate gear, a clutch mechanism, and an elastic member. The input gear receives the rotational power from the transport motor. The intermediate gear, which engages with the input gear, receives the rotational power from the transport motor via the input gear and transmits the received rotational power to the paying out rotor. When the cartridge is attached, the clutch mechanism suppresses the input gear from rotating in a first input direction and the intermediate gear from rotating in a first intermediate direction and permits the input gear to rotate in a second input direction and the intermediate gear to rotate in a second intermediate direction; the second input direction is opposite to the first input direction, and the second intermediate direction is opposite to the first intermediate direction. The elastic member applies force to the intermediate gear in the second intermediate direction to reserve a clearance between the input gear and the intermediate gear and next to a front end of the intermediate gear in the first intermediate direction.

The above configuration reserves the clearance between the input gear and the intermediate gear and next to the front end of the intermediate gear in the first intermediate direction when the cartridge is attached to the cartridge mount section. The intermediate gear is thus rotatable in the first intermediate direction until the clearance is removed. As a result, the paying out rotor is rotatable in a first paying out direction. Therefore, the cartridge can be attached smoothly to the cartridge mount section even if the paying out core abuts against the paying out rotor in the course of the attaching.

What is claimed is:

1. A ribbon transport mechanism provided in a tape printing apparatus, comprising:

a paying out rotor configured to engage a paying out core of a cartridge, wherein an ink ribbon is wound around the paying out core;

a winding rotor configured to engage a winding core that winds the ink ribbon paid out from the paying out core;

a transport motor that generates rotational power; and a transport gear train that transmits the rotational power from the transport motor to the paying out rotor, the transport gear train including:

an input gear that receives the rotational power from the transport motor;

an intermediate gear that engages with the input gear, receives the rotational power from the transport motor via the input gear, and transmits the received rotational power to the paying out rotor by engaging with another gear of the transport gear train;

a clutch mechanism that, when the cartridge is attached, suppresses the input gear from rotating in a first input direction and the intermediate gear from rotating in a first intermediate direction and permits the input gear to rotate in a second input direction and the intermediate gear to rotate in a second intermediate direction, the second input direction being opposite to the first input direction, the second intermediate direction being opposite to the first intermediate direction; and an elastic member that applies force to the intermediate gear in the second intermediate direction to reserve a clearance between the input gear and the intermediate gear and next to a front end of the intermediate gear in the first intermediate direction, wherein the input gear and the intermediate gear share a common axis and are rotatable relative to one another in a limited amount corresponding to the clearance.

2. The ribbon transport mechanism according to claim 1, wherein the input gear is coaxial with the intermediate gear, one of surfaces of the input gear which is closer to the intermediate gear is provided with an input-gear-side engaging section, one of the surfaces of the intermediate gear which is closer to the input gear is provided with an intermediate-gear-side engaging section, the intermediate-gear-side engaging section engaging with the input-gear-side engaging section, and both the input-gear-side engaging section and the intermediate-gear-side engaging section reserve a clearance in-between.

3. The ribbon transport mechanism according to claim 1, wherein the clutch mechanism that includes an inner gear member and an outer gear member, the outer gear member being disposed on an outer circumference of the inner gear member, when the cartridge is attached, in a case in which the input gear attempts to rotate in the first input direction and the intermediate gear attempts to rotate in the first intermediate direction, the clutch mechanism causes the inner gear member to engage with the outer gear member to suppress the input gear from rotating in the first input direction and the intermediate gear from rotating in the first intermediate direction, and when the cartridge is attached, in a case in which the input gear attempts to rotate in the second input direction and the intermediate gear attempts to rotate in the second intermediate direction, the clutch mechanism disengages the inner gear member from the outer gear member to permit the input gear to rotate in the second input direction and the intermediate gear to rotate in the second intermediate direction.

4. The ribbon transport mechanism according to claim 1, wherein the clutch mechanism includes a first clutch gear that receives the rotational power from the transport motor, a second clutch gear that engages with the first clutch gear, and a third clutch gear that engages with or is disengaged from the second clutch gear, when the cartridge is attached, in a case in which the input gear attempts to rotate in the first input direction and the intermediate gear attempts to rotate in the first intermediate direction, the clutch mechanism causes the second clutch gear to engage with the third clutch gear to suppress the input gear from rotating in the first input direction and the intermediate gear from rotating in the first intermediate direction, and when the cartridge is attached, in a case in which the input gear attempts to rotate in the second input direction and the intermediate gear attempts to rotate in the second intermediate direction, the clutch mechanism disengages the second clutch gear from the third clutch gear to permit the input gear to rotate in the second input direction and the intermediate gear to rotate in the second intermediate direction.

5. The ribbon transport mechanism of claim 1, wherein the other gear is not coaxial with the input gear and the intermediate gear.

6. The ribbon transport mechanism of claim 5, wherein the elastic member is between the input gear and the intermediate gear along the common axis.

7. The ribbon transport mechanism of claim 1, wherein the input gear includes a first protrusion protruding toward the intermediate gear, the intermediate gear includes a second protrusion protruding towards the input gear, and the clearance is circumferentially between the first protrusion and the second protrusion.

8. A tape printing apparatus to which a cartridge is to be attached, the cartridge including a paying out core around which an ink ribbon is wound and a winding core that winds the ink ribbon paid out from the paying out core, the tape printing apparatus comprising:

a cartridge mount section to which the cartridge is to be attached;

a paying out rotor that, when the cartridge is attached to the cartridge mount section, engages with the paying out core;

a winding rotor that, when the cartridge is attached to the cartridge mount section, engages with the winding core;

a transport motor that generates rotational power;

a transport gear train that transmits the rotational power from the transport motor to the paying out rotor; and a printing head that performs a printing operation on a print tape, the transport gear train including:

an input gear that receives the rotational power from the transport motor;

an intermediate gear that engages with the input gear, receives the rotational power from the transport motor via the input gear, and transmits the received rotational power to the paying out rotor by engaging with another gear of the transport gear train;

a clutch mechanism that, when the cartridge is attached, suppresses the input gear from rotating in a first input direction and the intermediate gear from rotating in a first intermediate direction and permits the input gear to rotate in a second input direction and the intermediate gear to rotate in a second intermediate direction, the second input direction being opposite to the first input direction, the second intermediate direction being opposite to the first intermediate direction; and an elastic member that applies force to the intermediate gear in the second intermediate direction to reserve a clearance between the input gear and the intermediate gear and next to a front end of the intermediate gear in the first intermediate direction; wherein the input gear and the intermediate gear share a common axis and are rotatable relative to one another in a limited amount corresponding to the clearance.

9. The tape printing apparatus of claim 8, wherein the other gear is not coaxial with the input gear and the intermediate gear.

10. The tape printing apparatus of claim 9, wherein the elastic member is between the input gear and the intermediate gear along the common axis.

11. The tape printing apparatus of claim 8, wherein the input gear includes a first protrusion protruding toward the intermediate gear, the intermediate gear includes a second protrusion protruding towards the input gear, and the clearance is circumferentially between the first protrusion and the second protrusion.

* * * * *